United States Patent [19]

Horikoshi et al.

[11] 4,263,397

[45] Apr. 21, 1981

[54] PHOTOGRAPHIC PRODUCTS

[75] Inventors: Akira Horikoshi; Zene Kumagai, both of Hino, Japan

[73] Assignee: Konishiroku Photo Industry Co., Ltd., Tokyo, Japan

[21] Appl. No.: 907,608

[22] Filed: May 19, 1978

[30] Foreign Application Priority Data

May 24, 1977 [JP] Japan ..... 52-60207

[51] Int. Cl.[3] ..... G03C 1/76

[52] U.S. Cl. ..... 430/542; 430/496; 430/544; 430/550; 430/583; 430/588; 430/584; 430/591; 430/592

[58] Field of Search ..... 96/67, 201, 89, 73; 260/578, 497, 316; 55/387; 206/204; 252/194; 430/542, 496, 544, 583, 584, 588, 591, 592

[56] References Cited

U.S. PATENT DOCUMENTS

| | | | |
|---|---|---|---|
| 1,564,707 | 12/1925 | Palmer et al. | 206/316 |
| 2,080,066 | 5/1937 | Sheppard et al. | 55/387 |
| 3,515,333 | 6/1970 | Kotkas et al. | 206/316 |
| 3,615,539 | 10/1971 | Land | 96/29 R |
| 3,758,465 | 9/1973 | Jenkins | 96/89 |

FOREIGN PATENT DOCUMENTS

| | | | |
|---|---|---|---|
| 728569 | 11/1942 | Fed. Rep. of Germany | 96/67 |
| 317267 | 8/1929 | United Kingdom | 96/67 |

OTHER PUBLICATIONS

Solovev, Chemical Abstracts, vol. 52, p. 10775 (1958).

Birr, Stabilization of Photographic Silver Halide Emulsions, pp. 108 to 123, Focal Press, England ©1974.

*Primary Examiner*—J. Travis Brown

*Attorney, Agent, or Firm*—Frishauf, Holtz, Goodman & Woodward

[57] ABSTRACT

A photographic product comprising, in a package, a light-sensitive silver halide photographic material having a silver halide emulsion layer coated on a support, characterized in that said silver halide emulsion layer contains a sensitizing or desensitizing dye and that the oxygen permeability of the package is below $5\times10^2$ cc/m$^2$. 24 hrs. atm. under a condition at 20° C. and 0% of relative humidity and further that the sealed package is under a condition that a partial pressure of an oxygen-gas in the package is not more than 1/6 atmospheres at an initial stage.

14 Claims, No Drawings

PHOTOGRAPHIC PRODUCTS

The invention relates to a photographic product of a light-sensitive silver halide photographic material sealed up in a package. More particularly, it relates to a process for prolonging the life of the light-sensitive silver halide photographic material remarkably by selecting an adequate material for the package in which the light-sensitive silver halide photographic material comprising a light-sensitive dye is sealed up, and by determining appropriate conditions of the seal.

It is a fundamental subject of the industry to maintain semipermanently the photographic qualities of light-sensitive silver halide photographic materials after their production. Heretofore, it has been an object to prevent the degradation of photographic qualities of light-sensitive silver halide photographic materials during storage for a long period of time. The object of preventing the degradation of photographic qualities has been satisfied to some extent by preservation for a relatively short period of time. The objects therefor have been aimed at improvement of light-sensitive materials themselves, e.g., by incorporating different kinds of stabilizers into the light-sensitive silver halide materials. However, as stated above, it is a strong desire of the industry to achieve a longer period of preservation. This would also be preferred by customers in view of current distribution of the products. However, the object and the desire have not been sufficiently satisfied by improvements of the light-sensitive materials themselves. In the meantime, the causes of degradation of photographic qualities during storage for a long period have not been clarified due to complexity of molecular or electronic mechanism of light-sensitive silver halide photographic materials upon image formation. Accordingly, it is impossible even now by theoretical approaches to achieve the prolongation the period during which photographic qualities of the light-sensitive silver halide photographic materials are preserved. It is, therefore, an object of the invention to prevent the degradation of photographic qualities of light-sensitive silver halide photographic materials during storage for a long period. In other words, it is an object of the invention to prolong remarkably the period during which photographic qualities of light-sensitive silver halide photographic materials are maintained. The inventors completed the invention after many trials and errors. To wit, the inventors found that the object of the invention can be achieved by sealing up a light-sensitive silver halide photographic material having at least one light-sensitive silver halide photographic emulsion layer comprising at least one light-sensitive dye, coated on a support, with a package whose oxygen permeability is not more than $5\times10^2$ cc/m$^2$.24 hrs.atm. at 20° C. and 0% of relative humidity, under a condition of a partial pressure of an oxygen gas being not more than 1/6 atmospheres. There have been adopted, in the food industry or the like, techniques of sealing up contents within a package and further reducing the atmospheric pressure or substituting the gas within the package in order to improve the preservability of the contents or foods. However, the techniques do not always give good results when they are applied to the sealing of all kind of contents. In fact, according to the knowledge of the inventors obtained during these studies, the application of the known techniques to the sealing of light-sensitive silver halide photographic materials gave no satisfactory results. To wit, the inventors observed that the improvement of preservability of light-sensitive silver halide photographic materials could not be achieved when the photographic qualities thereof were tested after storage for a long period in accordance with the above-mentioned forms of seal, under a quite fundamental and simplified system. However, the inventors observed a quite different phenomenon under a system in which a sensitizing or desensitizing dye was incorporated into at least one emulsion layer of the light-sensitive silver halide photographic material. Further, the inventors observed that the degradation of photographic qualities was greater in a system comprising a sensitizing or desensitizing dye rather than in a system comprising no light-sensitive dye, after storage for a long period under normal conditions, i.e., conditions not satisfying the above-mentioned seal conditions. Furthermore, the inventors observed that the degradation of photographic qualities of light-sensitive materials comprising no sensitizing or desensitizing dye after storage for a long period could hardly be improved under the above-mentioned sealing conditions. To the contrary, the inventors observed that the degradation of photographic qualities after storage for a long period could be greatly prevented, if a sensitizing or desensitizing dye was present in the light-sensitive material and if the above-mentioned sealing conditions were satisfied; this was not the case under the system in which no sensitizing or desensitizing dye was present. Meanwhile, it might be considered to employ a refrigeration storage technique to prolong the period for storage of light-sensitive silver halide photographic materials without degradation. It is, however, clear that the invention is superior to each technique, comparing the expenses which dealers and consumers have to bear. The light-sensitive silver halide photographic materials of the invention include any of silver halide monochrome photographic materials, e.g., black and white panchromatic films, panlith- and ortholith films, microfilms, facsimile films, gravure films, panmasking films, indirect X-ray photographic films, highly sensitive direct X-ray orthofilms, direct X-ray photographic films, high resolutional dry plates, multigradient printing papers, photographic materials for monochrome diffusion transfer process, and any of silver halide color photographic materials, e.g., color negative films, color positive films, color reversal films coupler-in-emulsion type, coupler-in-developer type color aerial photographic films, color X-ray films, color printing papers, materials for silver dye-bleaching method, photographic material for color diffusion transfer process or the like as far as they include a sensitizing or desensitizing dye therein. The light-sensitive silver halide photographic materials of the invention will be explained as below. The light-sensitive silver halide photographic material of the invention has a light-sensitive silver halide emulsion layer coated on a support. Here, the emulsion layer comprises a binder in which a silver halide is dispersed, and in addition, contains the above-mentioned light-sensitive dye. As the silver halide employed for the silver halide emulsion layer of the light-sensitive silver halide photographic material of the invention are included, e.g., silver chloride, silver bromide, silver iodide, silver chlorobromide, silver iodobromide, silver chloroiodobromide or the like usually used for silver halide photographic emulsions. The silver halide grains may be prepared and adjusted by conventional methods. As the binder employed for the silver halide emulsion layer of light-sensitive material of the invention are mentioned, e.g., gelatin, cellulose derivatives, synthetic binders such as polyvinyl alcohol, water-soluble polymers, gelatin derivatives, graft copolymers of gelatin with monomers having polymerizable ethylene groups, or the like. The binder may be in the form of a mixture consisting of two or more components, if necessary. The light-sensitive silver halide photographic material of the invention may be prepared by coating the above-mentioned silver halide emulsion layer on a support having a good plane quality and showing little change in shape during production and processing. As the support are employed plastic films, plastic-laminated papers, baryta papers, synthetic papers, hard substances such as glass plates, metals and ceramics. It is essential in the invention that the silver halide emulsion layer, which is the necessary component of the light-sensitive silver halide photographic material, comprises a sensitizing or desensitizing dye in order to achieve the intended effect of the invention, i.e., large prolongation of the period for storage of the material while it is preserved. The sensitizing dye means a dye which imparts a color sensitivity at a desired light-sensitive wavelength region (i.e., spectral sensitization) when incorporated into a silver halide emulsion. In this case, the spectral sensitization is performed by way of energy transfer or electron transfer from the sensitized dye excited with the light to the silver halide through resonance. Combination use of different kinds of sensitizing dyes may achieve the effects of the invention. The sensitizing dye may be successfully used alone or together with others. As sensitizing dyes advantageously used in the invention are mentioned, in general, cyanine, merocyanine and oxonol dyes. As regards the desensitizing dyes, there may be employed combination use of different kinds of the dyes and they can achieve the effects of the invention. Here, the desensitizing dye means a dye which reduces the photographic sensitivity without destroying the latent image. In this case, the desensitization is performed by the capture of free electrons of the silver halide with the desensitized dye. The incorporation of the dye into the silver halide photographic emulsion may be performed by dispersing it in the emulsion direct. Alternatively, it may be performed by dissolving the dye in a solvent such as water, methanol, ethanol, acetone or methyl cellosolve, or a mixture thereof, and then adding the solution to the emulsion. Still alternatively, it may be performed by dissolving the dye in a substantially water-immiscible solvent such as phenoxyethanol, dispersing the solution in water or a hydrophilic colloid, and then adding the dispersed product to the emulsion. In case of a color emulsion, the dye may be added together with a hydrophobic compound such as a coupler. When light-sensitive dyes are used in combination, they may be dissolved either separately or admixed. Also, they may be added to the emulsion either separately or all at once. They may be added to the emulsion with other additives. The dye may be added to the emulsion before, after or during the chemical ripening. The amount of addition of a sensitizing or desensitizing dye will be about $10^{-6}$ to $10^{-2}$ mole per mole silver halide.

Representative examples of the dye may be indicated by the following general formulae [I] to [IX].

GENERAL FORMULA [I]:

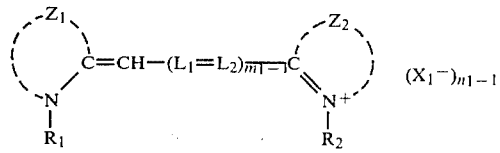

(wherein, $Z_1$ and $Z_2$ each represents a group necessary for forming a heterocyclic nucleus usually employed for the cyanine dye such as thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole and indolenine nuclei. The nuclei may be substituted with a lower alkyl group such as methyl, a halogen atom, a phenyl group, a hydroxy group, an alkoxy group having 1 to 4 carbon atoms, a carboxy group, an alkoxycarbonyl group, an alkyl sulfamoyl group, an alkylcarbamoyl group, an acetyl group, an acetoxy group, a cyano group, a trichloromethyl group, a trifluoromethyl group and/or a nitro group; $L_1$ or $L_2$ represents a methine group or a substituted methine group, wherein the substituent is usually an alkyl group such as methyl or ethyl, a phenyl group including phenyl and substituted phenyl, a methoxy group or the like; $R_1$ and $R_2$ each represents an alkyl group having 1 to 5 carbon atoms, substituted alkyl having a carboxy group, substituted alkyl having a sulfo group such as γ-sulfopropyl, δ-sulfobutyl, 2-(3-sulfopropoxy) ethyl, 2-[2-(3-sulfopropoxy)ethoxy]ethyl, 2-hydroxysulfopropyl, an allyl group or a substituted alkyl group usually employed for the N-substituent of the cyanine dye; $m_1$ represents 1, 2 or 3; $X_1^-$ represents an acid anion usually employed for the cyanine dye such as iodine, bromine, p-toluenesulfonic acid or perchloric acid anion; and n represents 1 or 2, provided that n is 1 when the dye molecule forms a betaine structure.).

GENERAL FORMULA [II]:

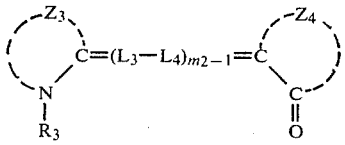

(wherein, $Z_3$ is an atomic group necessary for forming a heterocyclic nucleus usually employed for a cyanine dye, particularly, thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole and indolenine nuclei; $Z_4$ represents an atomic group necessary for forming a ketoheterocyclic nucleus usually employed for a merocyanine dye such as rhodanine, thiohydantoin, hydroxyindole, 2-thiooxazolinedione and 1,3-indanedione nuclei; $L_3$ and $L_4$ each represents methine or methine substituted with a lower alkyl group such as methyl and ethyl, phenyl, substituted phenyl, methoxy and/or ethoxy; $R_3$ has the same meaning as previously defined for $R_1$ and $R_2$; and $m_2$ represents 1, 2 or 3.).

GENERAL FORMULA [III]:

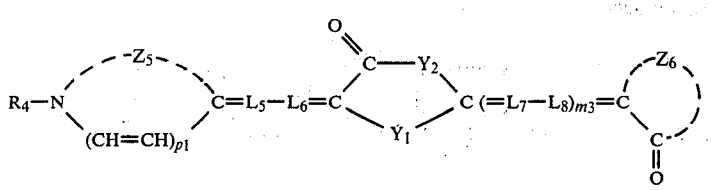

(wherein, $Z_5$ represents an atomic group necessary for forming 4-quinoline, 2-quinoline, benzothiazole, benzoselenazole, naphthothiazole, naphthoselenazole, naphthoxazole, benzoxazole or indolenine nucleus; $p_1$ represents 1 or 2; $R_4$ has the same meaning as previously defined for $R_1$ or $R_2$; $L_5$ and $L_6$ have the same meanings as previously defined for $L_3$ or $L_4$; $m_3$ represents 1 or 2; $L_7$ and $L_8$ have the same meanings as previously defined for $L_1$ or $L_2$; $Z_6$ has the same meaning as previously defined for $Z_4$; and $Y_1$ and $Y_2$ each represents an oxygen atom, a sulfur atom, a selenium atom or a group $=N-R_5$ ($R_5$ is an alkyl group having up to 8 carbon atoms such as methyl, ethyl or propyl, or an allyl group), provided that at least one of them is the group $=N-R_5$.).

GENERAL FORMULA [IV]:

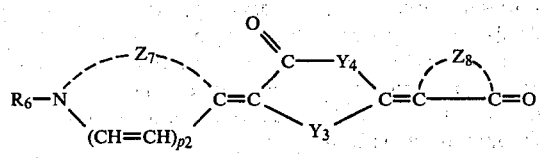

(wherein, $Z_7$, $Z_8$, $R_6$ and $p_2$ have the same meaning as previously defined for $Z_5$, $Z_6$, $R_1$ or $R_2$, and W, respectively).

GENERAL FORMULA [V]:

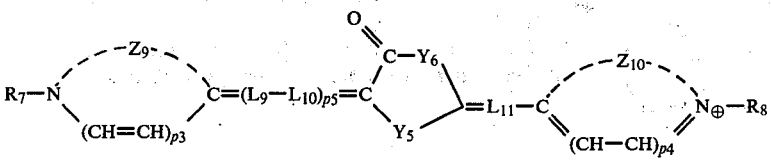

(wherein, $R_7$ and $R_8$; $Z_9$ and $Z_{10}$; $p_3$ and $p_4$; $L_9$, $L_{10}$ and $L_{11}$; $X_2$; $n_2$; and $Y_5$ and $Y_6$ have the same meanings as previously defined for $R_1$ or $R_2$; $Z_5$; W; $L_1$ or $L_2$; $X_1$; $n_1$; and $Y_1$ and $Y_2$, respectively; and $R_5$ represents 0 or 1.).

GENERAL FORMULA [VI]:

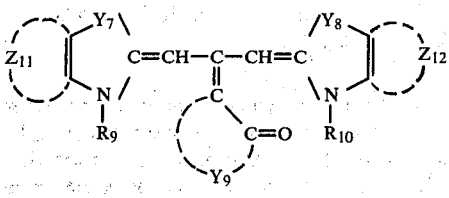

(wherein, $Z_{11}$ and $Z_{12}$ each represents an atomic group necessary for forming a benzene or naphthalene nucleus, which may be substituted with a lower alkyl group especially such as methyl, a halogen atom, a phenyl group, hydroxy, an alkoxy group having 1 to 4 carbon atoms, a carboxy group, an alkoxycarbonyl group, an alkylsulfamoyl group, an alkylcarbamoyl group, an acetyl group, a cyano group, a trichloromethyl group or nitro; $R_9$ and $R_{10}$ have the same meanings as previously defined for $R_1$ or $R_2$; $Y_7$ and $Y_8$ each represents an oxygen atom, a sulfur atom, a selenium atom, a group

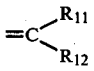

($R_{11}$ and $R_{12}$ are methyl or ethyl), a group $=N-R_{11}$ $(X_2^-)_{n2-1}$ ($R_{11}$ is alkyl, substituted alkyl usually employed for the N-substituent of the cyanine dye, or an allyl group), or $-CH=CH-$; and $Y_9$ represents an atomic group necessary for forming a 5- or 6-membered heterocyclic nucleus).

GENERAL FORMULA [VII]:

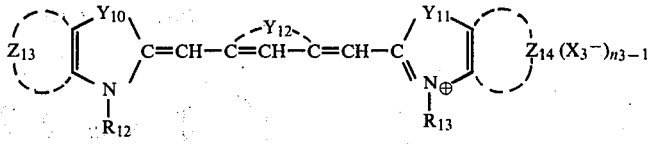

(wherein, $Z_{13}$ and $Z_{14}$, $R_{12}$ and $R_{13}$, and $Y_{10}$ and $Y_{11}$ have the same meanings as previously defined for $Z_{11}$ or $Z_{12}$, $R_1$ or $R_2$, and $Y_7$ and $Y_8$, respectively; $Y_{12}$ represents an atomic group necessary for forming a 5- or 6-membered carbon cycle; and $X_3$ and $n_3$ have the same meanings as previously defined for $X_1$ and $n_1$, respectively.).

GENERAL FORMULA [VIII]:

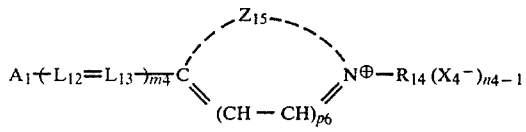

GENERAL FORMULA [IX]:

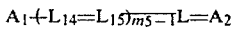

(wherein, $X_4$ has the same meaning as previously defined for $X_1$; $m_4$ and $m_5$ each represents 1 or 2; $L_{12}$, $L_{13}$, $L_{14}$ and $L_{15}$ have the same meanings as previously defined for $L_1$ or $L_2$; and $Z_{15}$ has the same meaning as previously defined for $Z_1$ or $Z_2$.).

Preferable for $A_1$ are:

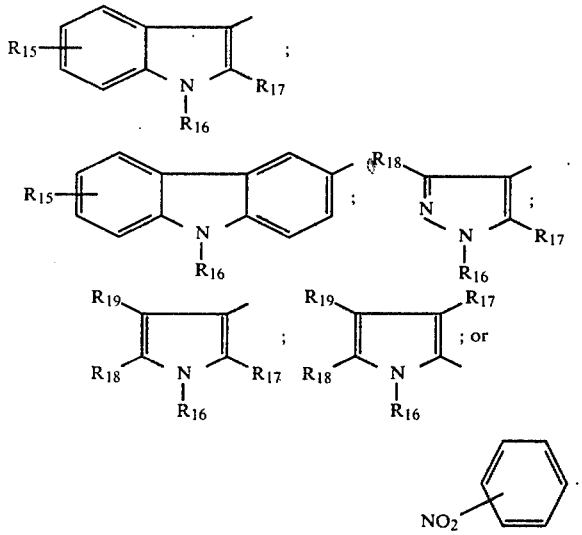

Preferable for $A_2$ are:

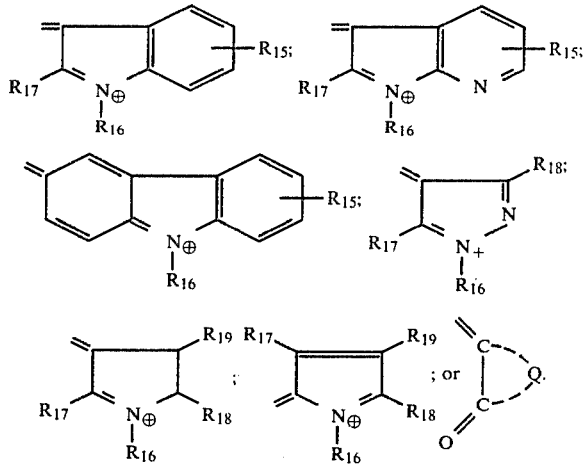

In the above formulae, $R_{14}$ and $R_{16}$ each represents hydrogen, alkyl, substituted alkyl or an aryl group; $R_{15}$ represents halogen, nitro, a lower alkyl group, an alkoxy group, an alkoxycarbonyl group, an alkylsulfonyl group or an arylsulfonyl group; $R_{17}$, $R_{18}$ and $R_{19}$ each represents hydrogen, an alkyl group, a cycloalkyl group, an aryl group, a pyridyl group, a carboxy group or an alkoxycarbonyl group; Q is an atomic group necessary for forming a 5- or 6-membered heterocyclic nucleus such as rhodanine, 2-thiooxazolinedione, 2-thiohydantoin or barbituric acid.

The above-mentioned dyes may readily be prepared based on the descriptions of patent specifications and literature known in the photographic field.

Among the above-mentioned dyes, those represented by general formulae [I] or [II] are preferable, for they contribute much more to the improvement of preservability when the package conditions of the invention are satisfied.

Concrete examples of the dyes represented by the above general formulae will be given below:

D-1

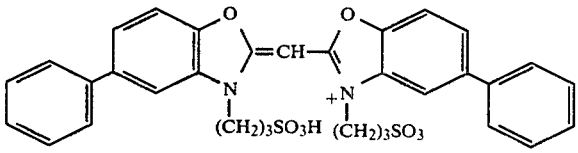

D-2

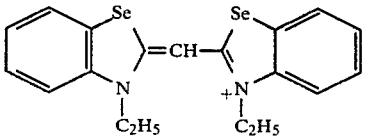

D-3

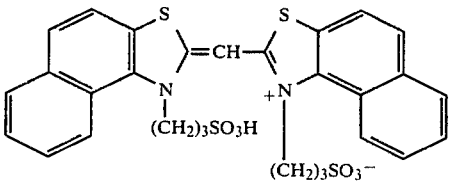

-continued
D-4
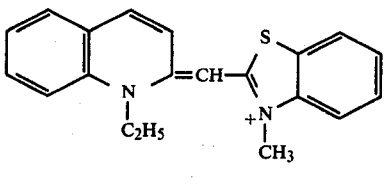
D-5
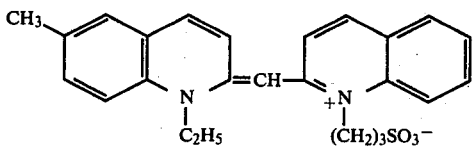
D-6
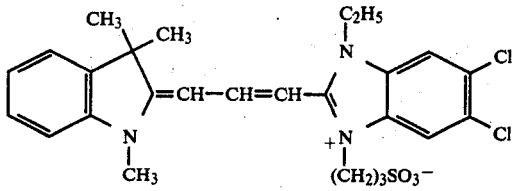
D-7
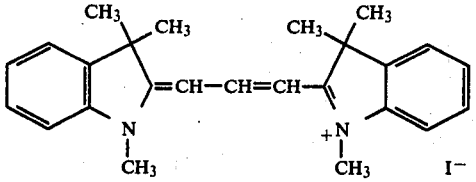
D-8
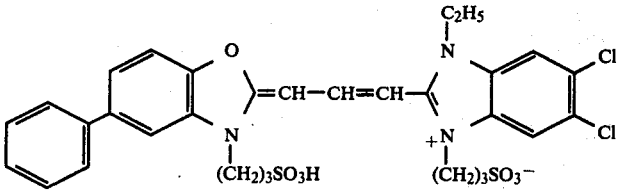
D-9
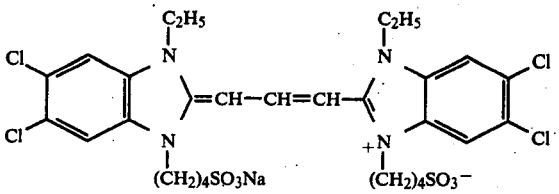
D-10
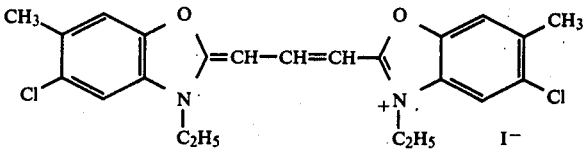
D-11
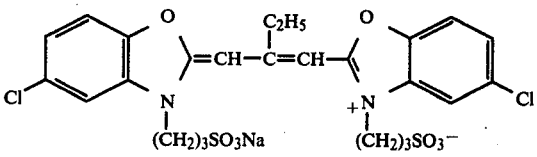
D-12
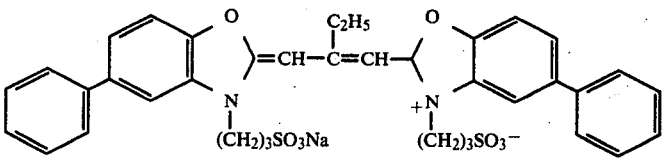
D-13
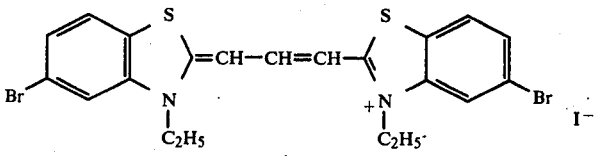

-continued
D-14
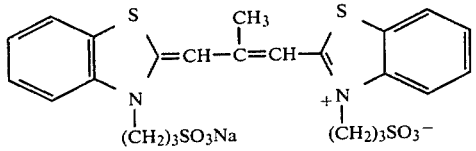
D-15
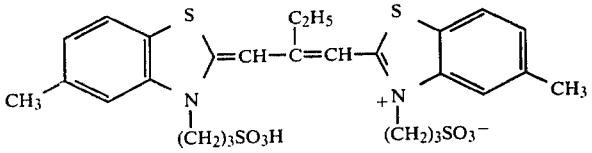
D-16
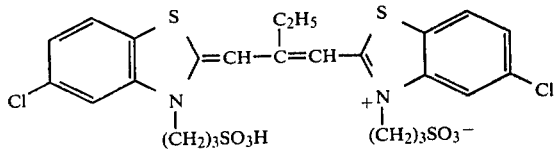
D-17
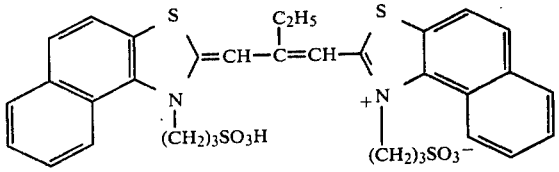
D-18
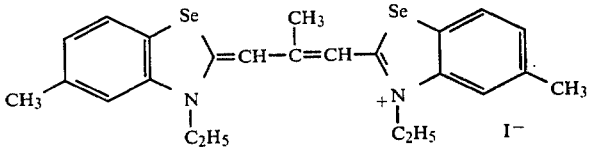
D-19
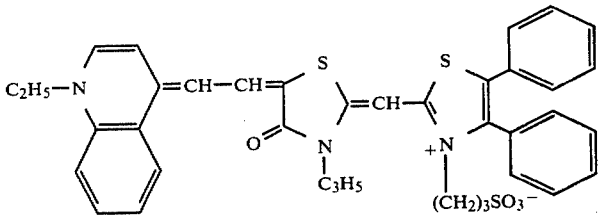
D-20
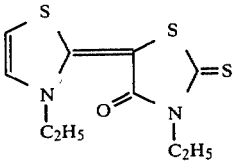
D-21
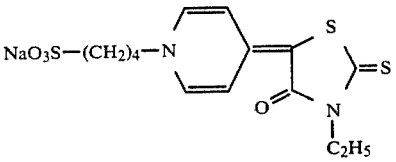
D-22
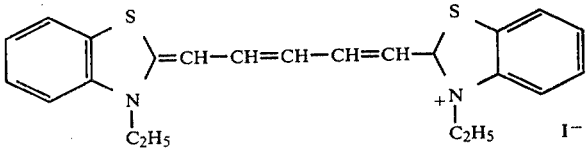
D-23
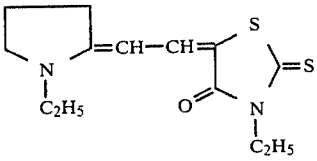

-continued
D-24
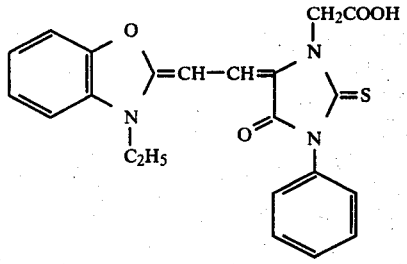
D-25
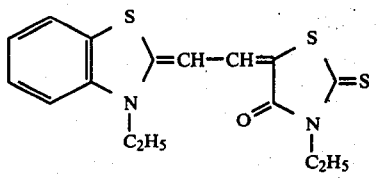
D-26
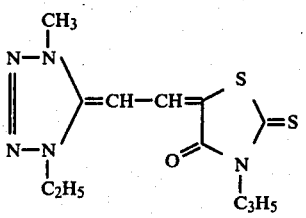
D-27
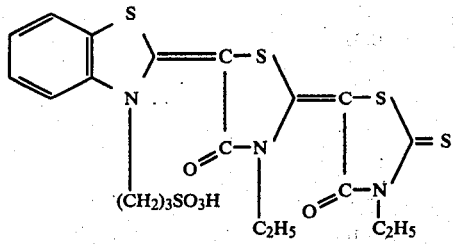
D-28
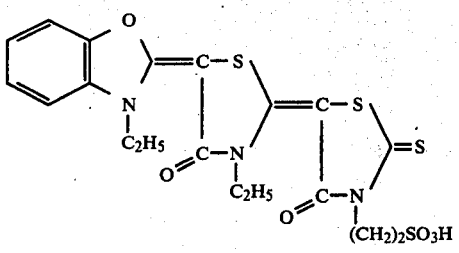
D-29
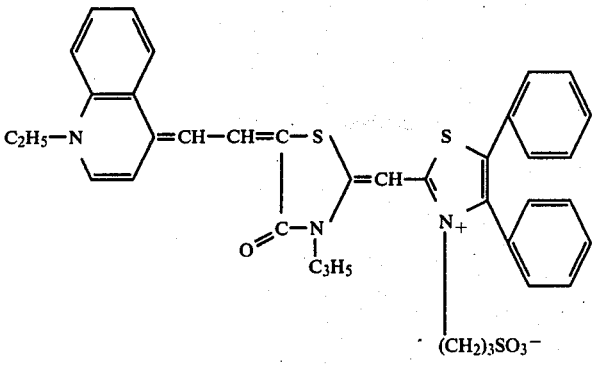

-continued
D-30
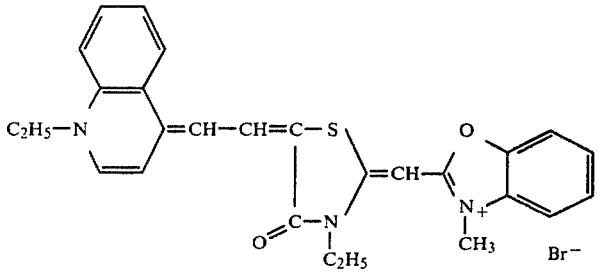
D-31
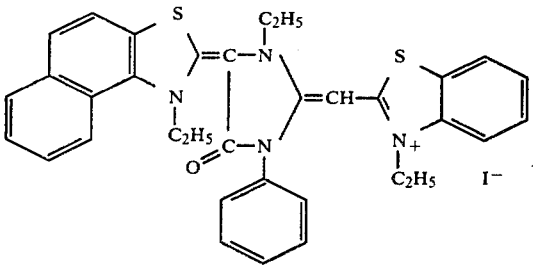
D-32
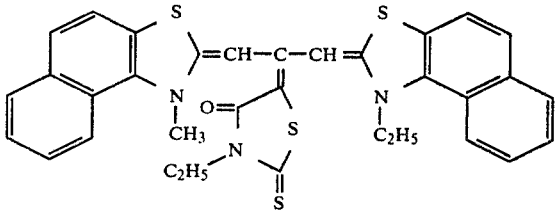
D-33
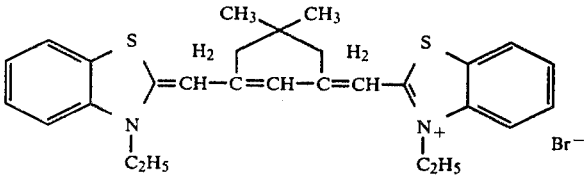
D-34
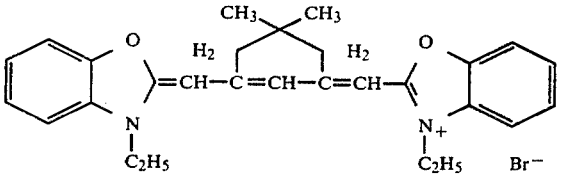
D-35
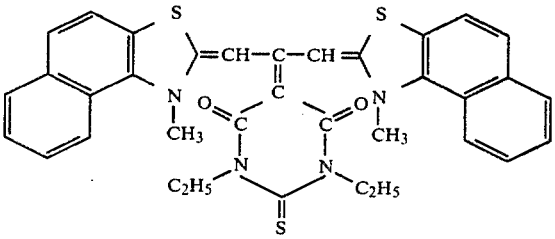
D-36
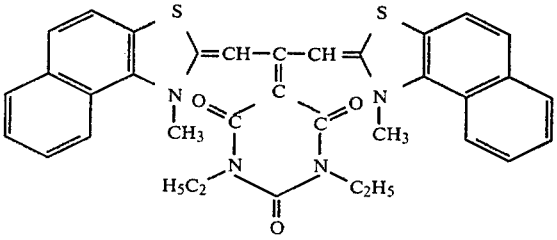

-continued
D-37
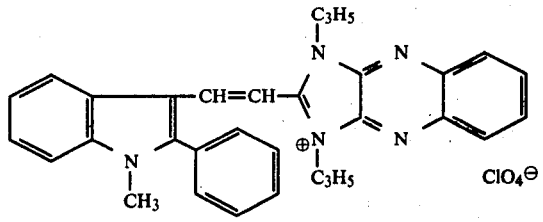
D-38
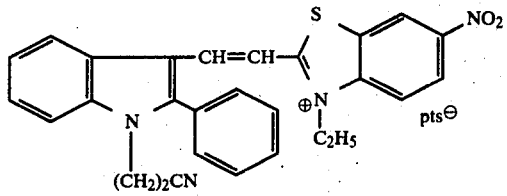
D-39
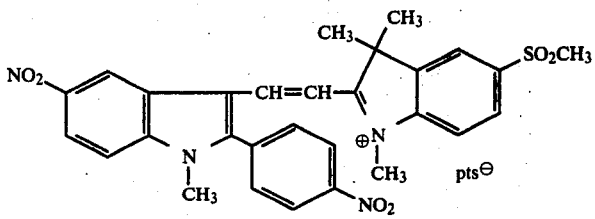
D-40
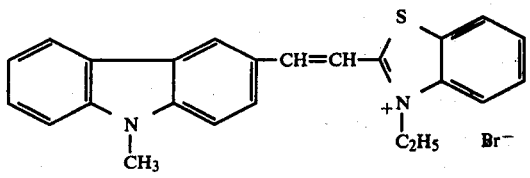
D-41
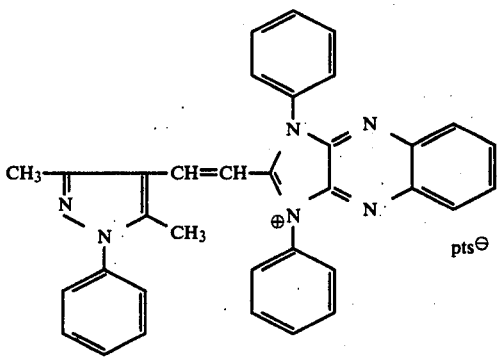
D-42
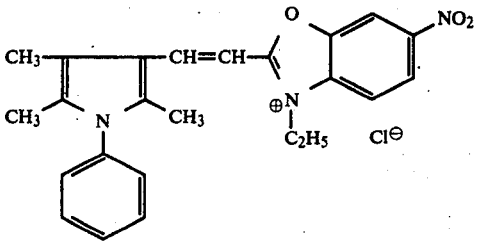
D-43
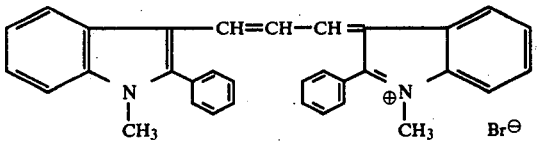
D-44
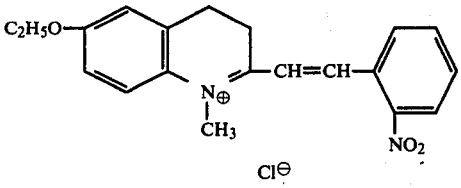

-continued
D-45
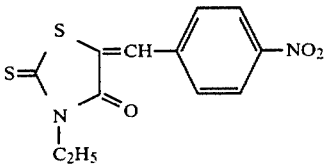
D-46
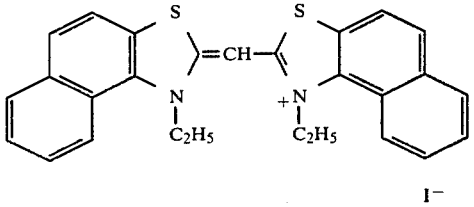
D-47
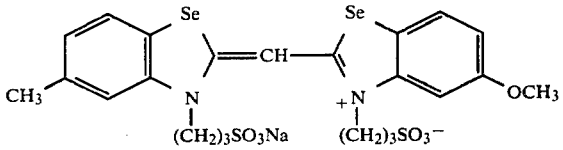
D-48
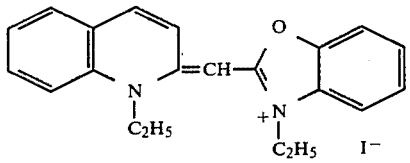
D-49
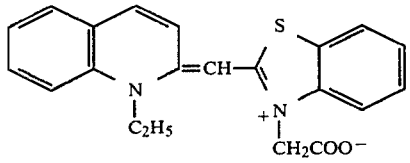
D-50
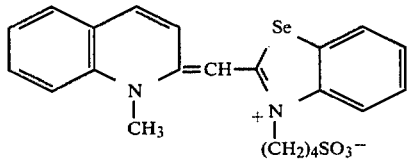
D-51
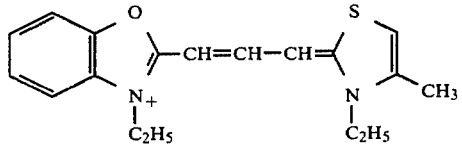
D-52
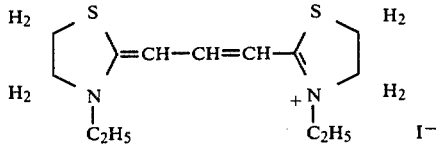
D-53
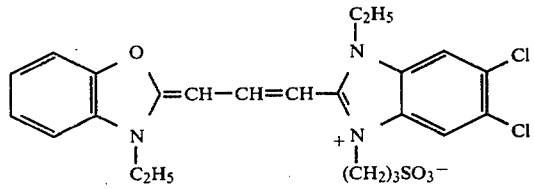
D-54
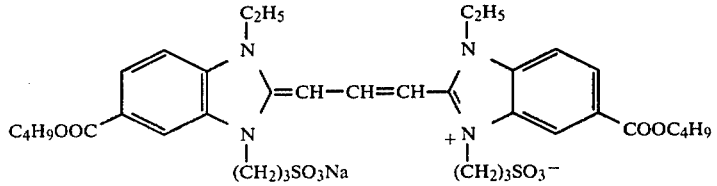

-continued
D-55
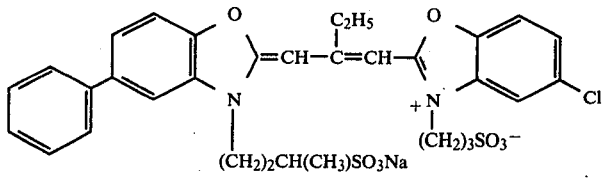
D-56
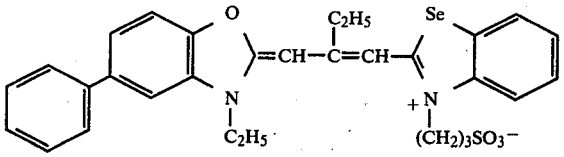
D-57
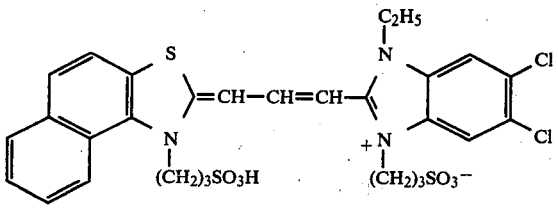
D-58
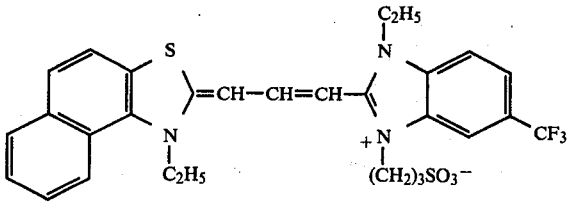
D-59
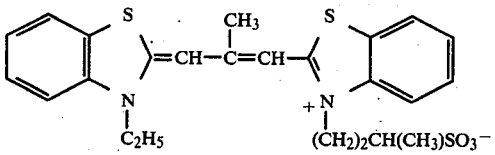
D-60
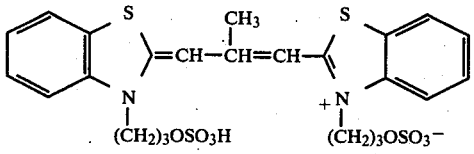
D-61
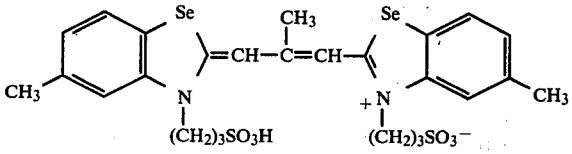
D-62
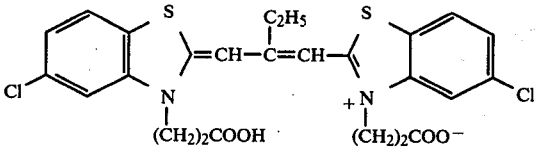
D-63
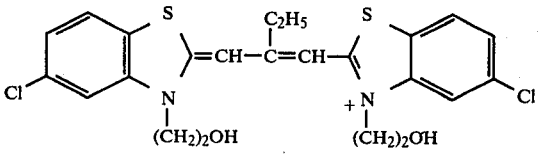

-continued
D-64
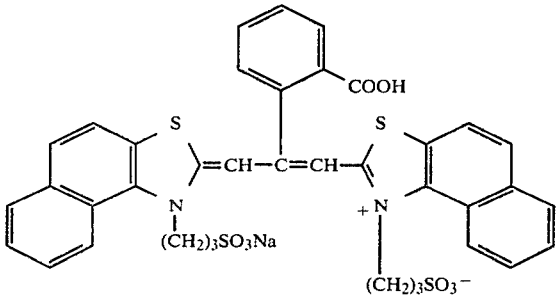
D-65
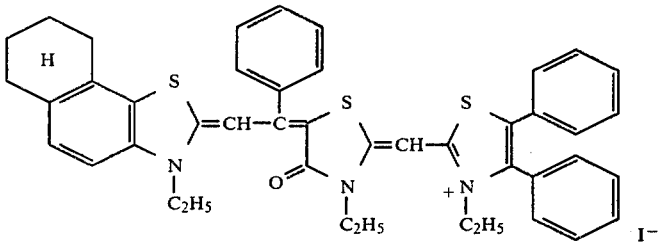
D-66
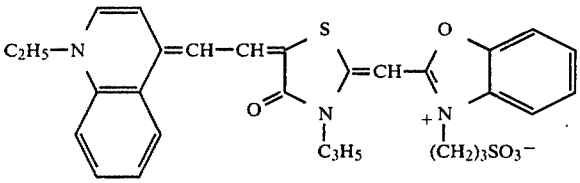
D-67
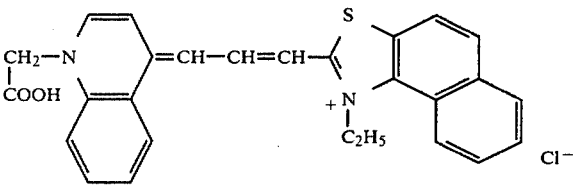
D-68
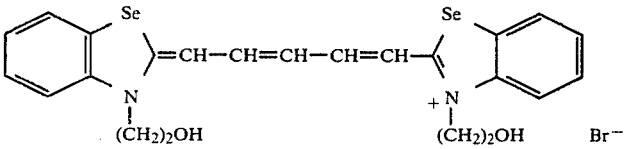
D-69
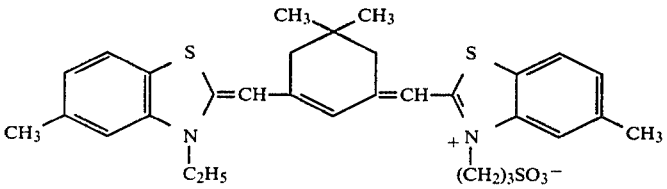
D-70
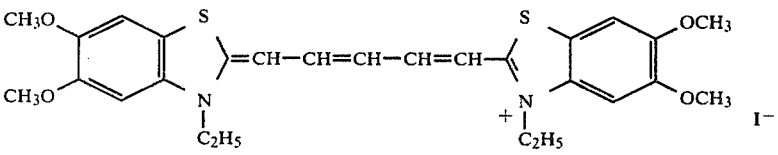
D-71
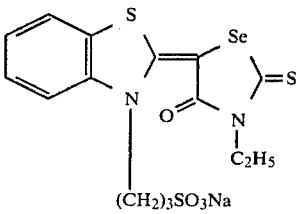

-continued
D-72
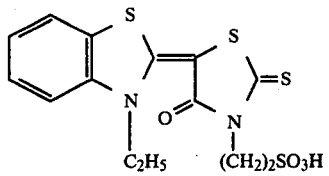
D-73
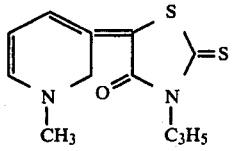
D-74
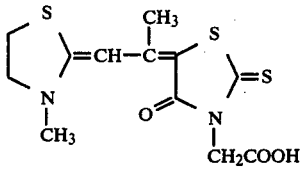
D-75
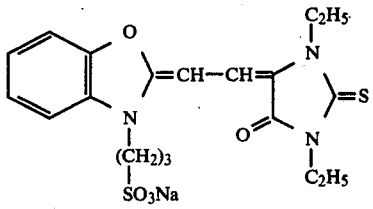
D-76
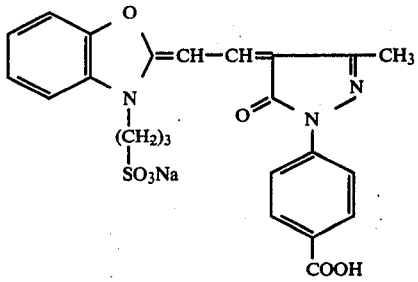
D-77
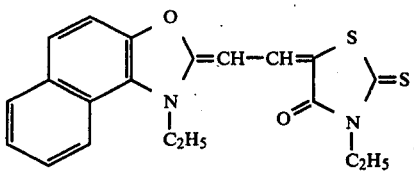
D-78
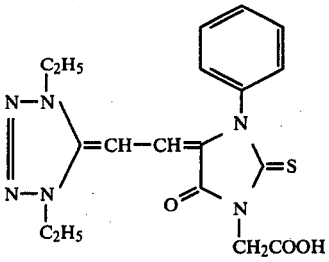
D-79
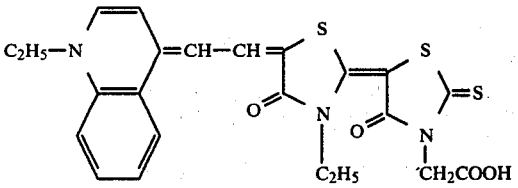

-continued

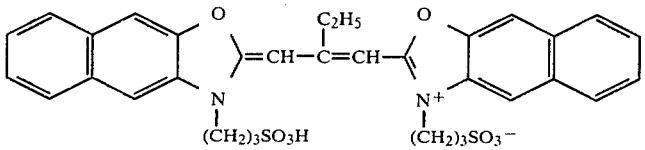

D-80

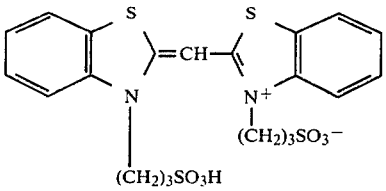

D-81

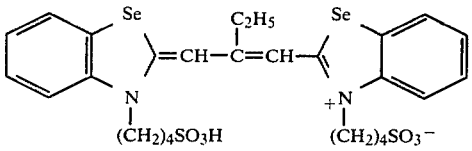

D-82

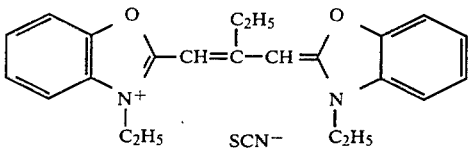

D-83

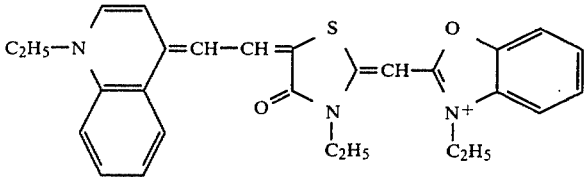

D-84

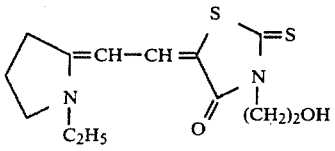

D-85

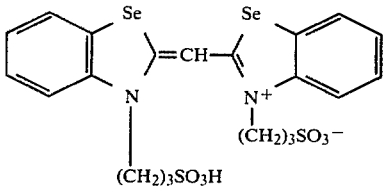

D-86

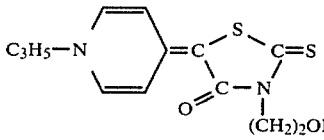

D-87

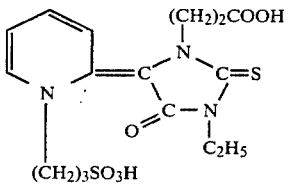

D-88

In this invention, the above-mentioned light-sensitive silver halide photographic material is sealed up in a package.

Here, the package may form any shape as long as it can seal up the light-sensitive silver halide photographic material completely, depending on the use purpose and shape of the light-sensitive material to be sealed up. Usually, it takes the form of a cylindrical or angular prism shaped receptacle, or a case prepared by heat-sealing. What is important in the invention is that the oxygen gas permeability of the package should be below $5\times10^2$ cc/m$^2$.24 hrs.atm. at 20° C. and 0% of relative humidity. The permeability rate (q) of oxygen as to a film-shaped material may be given by the following Fick's equation:

$$q = \frac{P(p_1 - p_2)a \cdot t}{l}$$

(wherein l represents the thickness of the material; a represents area of the material; t represents time; $p_1$ and $p_2$ each represents pressure values at the both sides of the material; and P represents a permeability coefficient.).

In this specification, the term "oxygen gas permeability" means the oxygen permeation coefficient per thickness of material (P/l) and the unit is cc/m$^2$.24 hrs.atm. To wit, the value is indicated by cc (cubic centimeter) of an oxygen gas permeating through a material of 1 m$^2$ of the surface area per day at 1 atom disparity.

The measurement of the oxygen permeability coefficient or oxygen permeability is prescribed in, e.g., ASTM D1434. The oxygen permeability of a package material may readily be determined in the light of the above description.

Materials which satisfy the condition of not more than $5\times10^2$ cc/m$^2$.24 hrs.atm. are as follows:

(1) Monolayer materials (a) metals usually employed for conventional packages such as aluminum, tin plate, lead or iron: oxygen permeabilities thereof by the above-mentioned measurement show almost zero if the thickness thereof is above several microns.

(b) glass having an ordinary thickness for receptacles (c) synthetic resins polyvinylidene chloride (thickness of above 0.03 mm), non-plasticized polyvinyl chloride (thickness of above 1 mm), rubber hydrochloride (thickness of above 0.8 mm), polyethylene terephthalate (thickness of above 0.2 mm), Nylon 6 (thickness of above 0.5 mm) or the like, in view of their processability.

(2) Compound materials

Materials commonly used for compound materials are polyethylene (PE), polypropylene (non-stretched CPP, biaxially stretched OPP), polyvinylidene chloride (PVDC), polyester (polyethylene terephthalate, PET), Nylon (N), polyvinylalcohol (PVA), polyvinyl chloride (PVC), polycarbonate (PC), ethylene vinyl acetate copolymer (EVA), vinyl chloride/vinylidene chloride copolymer ("Saran", registered trademark of Asahi-Dow), beside cellophane, paper and aluminum foil (Al).

The fundamental component is a non-thermoplastic material such as cellophane, paper or Al, to which a plastic material such as PE, PP or the like is compounded.

Typical compounds satisfying the above-mentioned conditions are as follows:

(a) Double layer compounds

PE/N (N thickness: >0.5 mm), PE/Al (Al thickness: >1μ), PE/PVC (PVC thickness: >1 mm), PVDC/PVC (PVDC thickness: >0.05 mm; e.g., PVC 100μ, PVDC 200μ), N/PP (N thickness: >0.3 mm; e.g., N 300μ, PP 200μ), cellophane/Saran, vacuum metallizing resins (e.g., polyester 500μ, upon which Al 200μ is coated).

(b) Triple layer compounds

PE/Al/cellophane (Al thickness: >7μ), PE/Al/paper, PE/Al/PET/, PE/Al/N, PE/Al/PP, etc.; triple layer compounds made of synthetic resins such as PE/N/PE (e.g., Pe 40μ, N 300μ, PE 40μ), PE/PVPC-/moisture-proof cellophane (MPC) (e.g., PE 50μ, PVDC 30μ, MPC 40μ), PE/PVDC/PVC (e.g., PE 60μ, PVDC 40μ, PVC 80μ), DE/PET/PVDC (e.g., PE 60μ, PET 28μ, PVDC 30μ), PE/N/PVDC (e.g., PE 40μ, N 30μ, PVDC 30μ), N/PP (e.g., N 115μ, PP 600μ), etc.; vacuum metallizing compounds (e.g., a resin consisting of Nylon 100μ and polyethylene 300μ, upon which Al or Cr 200μ is coated.)

(c) Compounds having more than triple layers PE-/Al/PE/cellophane (Al thickness: >7μ), PE/-paper/PE/Al, PE/Al/cellophane/PVDC, PE/Al/-PE/PP, PE/Al/PE/cellophane/PVDC, PE/Al/-PE/PP, PE/Al/PE/cellophane/PVDC, PE/paper-/Al/PE/PE, PE/Al/PE/N, PE/Al/PE/Saran, etc.; PP/PE/PVDC/MPC (e.g., PP 50μ, PE 30μ, PVDC 30μ, MPC 60μ), PP/PE/PVDC/MPC/PE (e.g., PP 50μ, PE 30μ, PVDC 20μ, MPC 30μ, PE 15μ), PE/N-/PE/MPC (e.g., PE 40μ, N 40μ, PE 15μ, MPC 60μ), ionomer/N/PE/MPC (e.g., ionomer 30μ, N 40μ, PE 15μ, MPC 60μ), etc.

In this invention, more preferable effects may be attained by using a package whose oxygen permeability is below $2\times10^2$ cc/m$^2$.24 hrs.atm. under conditions at 20° C. and 0% of relative humidity.

Among the above-mentioned materials, those which satisfy the conditions are metals, glass, compound materials using aluminum of more than 7μ thick, vacuum metallized resins, as well as polyvinylidene chloride (>0.06 mm), polyethylene terephthalate (>0.6 mm), rubber hydrochloride (>2 mm), Nylon 6 (>1.5 mm) or the like.

Among the compound resin materials, those which satisfy the above-mentioned conditions are, for example, PVDC (100μ)/PVC (200μ), N (115μ)/PP (600μ), PE (50μ)/PVDC (30μ)/MPC (100μ), ionomer (30μ)/N (60μ)/PE (15μ)/MPC (100μ), PE (50μ)/PVDC (30μ)/MPC (40μ), PP (50μ)/DE (30μ)/PVDC (30μ)/MPC (60μ), PE (40μ)/PVDC (30μ)/PVC (200μ), PE (40μ)/N, (60μ)/PE (13μ)/MPC (100μ), PE (40μ)/N (30μ)/PVDC (40μ), or the like.

It can readily be confirmed by the above-mentioned measurement whether or not a package material satisfies the above-mentioned conditions.

In this invention, far more preferable effects may be attained by using a package whose oxygen permeability is not more than $1\times10$ cc/m$^2$.24 hrs.atm. under conditions at 20° C. and 0% of relative humidity.

Materials which satisfy the conditions are metals, glass, compound materials using a metal, polyvinylidene chloride (>2 mm). Various compound resin materials also satisfy the conditions; and this can readily be confirmed by the above-mentioned measurement.

When a package material containing a synthetic resin is employed in the invention, there may be admixed thereto a substance such as an organic dye, and an organic or inorganic pigment, e.g. carbon black, in order to impart a lighttightness property.

With regard to the shape of the package, preferable are a cylindrical or angular prism shaped receptacle plugged with an airtight cap, or a plastic or laminated bag whose opening is completely sealed up by, e.g. heat-sealing.

In the former case, the airtightness of the cap is achieved by various devices.

For instance, the seal may be performed by any one of the following procedures:

(1) The receptacle consists of a body and a cap. Both parts are cut to make screws, and the receptacle is sealed up by pressing both parts together with the screws.

(1-a) In above (1), an inert, elastic sheet such as raw rubber, neoprene or silicone compound, etc. is attached to the position inside the cap at which the fringe of the body touches upon pressing.

(1-b) In above (1), an inert paste such as silicone grease or vaseline is applied to the screw of the body so as to plug up the thread and the bottom of the thread.

(2) The receptacle consists of a body and a cap. A groove is provided inside the cap and the seal is performed by embedding the body to the groove.

(2-a) In above (2), an inert, elastic sheet is attached to plug up the space between the cap and the body.

(2-b) In above (2), an inert paste is applied so as to plug up the space between the cap and the body.

(3) A cap is attached to a body by way of either screwing or embedding supra, and outside of which cap is sealed up with an air-impermeable material. This may be performed, for example, by the heat-seal of opening of a bag.

(4) Particularly, in case of a metallic receptacle, an inner seal, which is usually a seal by use of a resin-laminated metal, is applied by heat-sealing.

(5) Particularly, in case of a metallic receptacle, a cap is applied with a so-called rotary vacuum seamer. As the cap to be applied, there may be employed usually a so-called easy open cap, besides an ordinary cap.

One skilled in the art may readily prepare a package by selecting the most suitable package material satisfying the above-mentioned oxygen permeability conditions, if the shape of the package and the method of the seal are determined in accordance with the use purpose, function and shape of the light-sensitive silver halide photographic material to be sealed up.

In this invention, it is essential to seal up the light-sensitive material with the above-mentioned package, under a condition of a partial pressure of an oxygen gas not more than 1/6 atmospheres. In fact, the partial pressure at which the seal is performed gives a substantial criticality as to whether or not the objects of the invention are achieved. The intended objects of the invention may not be achieved if either the oxygen permeability of the package or the oxygen partial pressure at the initial stage does not satisfy the above-mentioned conditions. The fact will be made clear in the Examples described hereinafter. It is preferable, in order to reduce the oxygen partial pressure to below 1/6 atmospheres at which the seal is performed, to reduce the atmospheric pressure inside the package or to substitute an inert gas for air, or to perform both procedures.

Alternatively, the reduction of the oxygen partial pressure inside the package to the predetermined value may also be achieved by incorporating a predetermined amount of a deoxygen agent or an oxygen absorber into the package when it is sealed up.

This use of a deoxygen agent is much more advantageous since this commercially gives extremely high productivity because it needs no apparatus to reduce the partial pressure of oxygen. Further, as the deoxygen agent keeps its oxygen absorbability for a long time, the partial pressure in a package can be kept low for a long time after sealing even if oxygen permeates into package. In this invention, "at initial stage" means "at a sealing stage" when the package is sealed up under the required condition, i.e. at not more than 1/6 atmospheres of the oxygen partial pressure, while it also means "at a stage later than the sealing stage and at a stage in which the pressure becomes not more than 1/6 atmospheres later by the deoxygen agent" when the deoxygen agent is used in the package and the sealing is conducted over 1/6 atmospheres of the oxygen partial pressure.

Representative examples of the deoxygen agents are as follows; active iron oxide, dithionite compounds (e.g. sodium dithionite, potassium dithionite, calcium dithionite, zinc dithionite or the like), sulfite compounds (e.g. sodium sulfite, potassium sulfite, calcium sulfite, calcium hydrogen sulfite or the like) or combination of glucose and glucose oxidase. These agents are used as a form of tablet, powder, sheet or others with active carbon, diatomaceous earth, pearlite, silica gel, amorphous silica, zeolite, active clay, alumina, talc or the like to be easy to handle and to improve the deoxidation effect.

The amount of the deoxygen agent varies experimentally depending on the kind of agent and its deoxygenation power. In general, however, 0.01 to 10 g per 100 ml air is employed there.

These deoxygen agents are sold on the market as we can see examples described in, for example, "Modern Packaging" p. 38, 1976, July.

It may be determined whether the partial oxygen pressure is within the prescribed range by measuring the total gas pressure inside the package, and the gas composition with, e.g. a mass spectrometer, sampling the gas.

The reduced pressure package may be performed by evacuating the inner space of the package.

A usual evacuation means comprises an evacuating chamber and a pump. When the evacuation within the chamber is completed, the package is sealed up as mentioned above.

As the inert gas used for the gas-charging package are employed nitrogen gas, carbon dioxide gas, freon gas, sulfur hexafluoride gas or inert gases such as neon, argon or krypton. Among the gases, nitrogen gas is preferably employed from an economical viewpoint. The nitrogen gas with a high purity (>99.99%) obtained by liquefying air and isolating therefrom is preferably employed. As the mode of gas-charging package are mentioned vacuum gas-charging package or gas flash type gas-charging package known in the industry. In this invention, any of vacuum method, nozzle type gas-charging method, chamber gas-charging method or pillow type gas flash method may be employed without decreasing the work efficiency.

As mentioned above, the oxygen partial pressure at which the seal is performed should be below 1/6 atmosphere, thereby achieving the effects of the invention critically. Better results may be obtained at a lower oxygen partial pressure of 1/10 atmosphere, more preferably 1/20 atmosphere. When sealing the package, an oxygen adsorber, moisture adsorber or the like may be put into the package together with the light-sensitive silver halide photographic material.

The light-sensitive silver halide photographic material of the invention will now be more fully explained.

The above-mentioned silver halide photographic emulsion that the silver halide grains are dispersed into a binder solution may be sensitized with a chemical sensitizer. The chemical sensitizers advantageously employed in the invention may be classified to four categories, i.e. noble metal sensitizers, sulfur sensitizers, selenium sensitizers and reduction sensitizers.

The light-sensitive material of the invention may contain a stabilizer within the silver halide emulsion layer.

The hardening of the emulsion may be performed according to conventional methods. As the hardener, there may be employed usual photographic hardeners.

A surfactant may be added, alone or together, to the silver halide emulsion of the invention. A lubricant is added to the reverse side of the film or the surface layer of the emulsion layers so as to decrease the slip friction or prevent abrasions of the film.

The light-sensitive silver halide photographic material of the invention may optionally contain, besides the silver halide emulsion layer, auxiliary layers such as a protective layer, intermediate layer, filter layer, halation-preventing layer or back layer or the like.

The light-sensitive silver halide photographic material of the invention may contain, in the composition layers, an ultraviolet absorber.

The above-mentioned support is generally subjected to sub-coating to strengthen the adhesion of the photographic emulsion layer thereto.

The coating of the emulsion layer or other layers may be performed by dip coating, double roll coating, air knife coating, extrusion coating or curtain coating.

The light-sensitive material of the invention may be a silver halide photographic material for color diffusion transfer reversal process. In this instance, a film unit comprising a receptacle explosible by applying pressure and containing a light-sensitive element, image-receiving element and developing solution is sealed up, as a whole, under the above-mentioned conditions.

In this invention, good results are obtained with light-sensitive materials used for various color diffusion transfer reversal process such as the so-called dye developer method, or the so-called DRR method which employs a compound releasing a diffusible dye by oxidation.

In this invention, it is essential that the silver halide emulsion layer, which is the necessary component layer of the light-sensitive silver halide photographic material, contains a light-sensitive dye, in order to achieve the intended effect of the invention, i.e. the remarkable prolongation of the storage period during which preservation of the film is maintained. Accordingly, every light-sensitive silver halide photographic material having any utility and function may be used, as long as it contains a light-sensitive dye. It has been found, however, that some embodiments of the light-sensitive materials are preferable in the invention, after extensive studies by the inventors.

To wit, light-sensitive silver halide color photographic materials are preferable in this invention. Among such materials more preferable are those which contain (i) a two equivalent coupler that is substantially colorless, or (ii) a development-inhibitor-releasing compound (DIR compound) which react with an oxidation product of an aromatic primary amine developing agent to yield a development-inhibiting substance.

It has been observed that, as compared with materials containing neither (i) nor (ii), the light-sensitive material containing the above-mentioned (i) or (ii) and a light-sensitive dye showed a reduction of photographic qualities, e.g. remarkable a decrease in sensitivity and $\gamma$ and increase in fog, after storage for a long period under normal conditions. In contrast thereto, such light-sensitive materials showed less decrease in sensitivity and $\gamma$, after storage for a long period, as compared with a light-sensitive color material containing neither (i) nor (ii), but containing the light-sensitive dye, under conditions satisfying the sealing and package requirements of the invention.

The fact will be made clear in Examples given hereinbelow.

As mentioned above, a remarkable prolongation of the storage period during which the film is preserved may not be achieved by heretofore known techniques for the prolongation of storage period. Namely, the known techniques which, for example, improve the light-sensitive material itself by incorporating thereto a stabilizer could prevent neither the degradation of photographic qualities nor the degradation of sensitivity and $\gamma$.

Accordingly, the above-mentioned findings would be quite unexpected for art-skilled workers.

Although the mechanism has not been discovered to date, the simultaneous presence of a light-sensitive dye and the above-mentioned (i) or (ii) in the invention brings about more preferable results due to some interaction.

As for the dye to be combined with the above-mentioned (i) or (ii), those represented by the above general formula [I] or [II] show preferable effects.

Here, the terms "two equivalent coupler that is substantially colorless" means a substantially colorless, non-diffusible coupler which forms a photographic color image by the coupling reaction with an oxidized derivative of the aromatic primary amine developing agent, and which has a group at the active point, i.e. the position at which the coupling reaction takes place, capable of releasing itself upon the coupling reaction, the compound formed by the release having no development-inhibiting activity.

The photographic image forming coupler advantageously employed in the invention includes optional coupling groups fit for photography. Representative photographic couplers are 5-pyrazolone couplers, phenol- or $\alpha$-naphthol series couplers and open chain ketomethylene couplers. As is well known in the art, the 5-pyrazolone couplers, phenol- or naphthol series couplers, and open chain ketomethylene couplers are used usually for the formation of Magenta dyes, cyano dyes and yellow dyes, respectively.

The coupling positions of the couplers are known in the art. That is, the 5-pyrazolone coupler undergoes the coupling reaction at the 4-position's carbon atom: the phenol- or naphthol series coupler undergoes the coupling reaction at the 4-position's carbon atom to the hydroxy group: and the open chain ketomethylene coupler undergoes the coupling reaction at the carbon atom forming an active point in the methylene group, e.g.

$$-\overset{\overset{\displaystyle O}{\|}}{C}-CH_2-.$$

The above-mentioned couplers may readily be synthesized in accordance with the descriptions of patent specifications and literature known in the industry.

The couplers may usually be contained in the silver halide emulsion layer in an amount ranging from $10^{-3}$–$5\times10^{-1}$ mole per mole the silver halide.

The DIR compound is advantageously employed in the invention, which releases a development inhibiting substance by reacting with an oxidation product of an aromatic primary amine developing agent. The DIR compound is classified, depending on the structure and function, to the so-called DIR coupler which forms a dye by reacting with the oxidation product of the developing agent, and the so-called DIR hydroquinone and DIR substance which forms a colorless compound by the reaction.

In this invention, both the two equivalent coupler that is substantially colorless and the DIR compound may more preferably achieve the intended effects of the invention, qualitatively and quantitatively, if they are employed together with the light-sensitive dye. However, use of the DIR compounds may achieve rather more preferable effects, qualitatively and quantitatively, i.e. prevention of degradation of sensitivity and $\gamma$ at the same time after storage for a long time.

Needless to say, the effects will become more remarkable if the photographic image-forming coupler of active point substitution type and the DIR compound are used together.

The DIR coupler has a substituent at the position where the coupling reaction takes place and is a photographic coupler, preferably an open chain ketomethylene-, 5-pyrazolone-, phenol- or $\alpha$-naphthol coupler.

The substituent contains no chromophore, and inhibits no development as long as it is linked to the coupler residue but inhibits development once it is released upon the reaction with the oxidation product of aromatic primary amine developing agent to form a diffusible mercaptane, a diffusible aryltriazole or the like.

These DIR couplers are described in U.S. Pat. Nos. 3,227,554 and 3,148,062, etc., or may readily be synthesized in accordance with the descriptions of the Patents.

Unlike DIR couplers or DIR substances, DIR hydroquinones release no development inhibiting agent but release the same by mutual oxidation with the oxidation product of the developing agent. However, the DIR hydroquinones and DIR couplers or DIR substances are common in that they inhibit development by reacting with the oxidation product of the developing agent.

Concrete examples of the DIR hydroquinones are described, together with preparation thereof, in U.S. Pat. Nos. 3,639,417 and 3,379,529 and Japanese Laid-open-to public Patent Publications, 49-129536 and 50-93971.

The DIR substances are common with the DIR couplers in that both undergo the coupling reaction with the oxidation product of the developing agent, but are different in that the former form substantially no dye image.

Concrete examples of the DIR substances are described, together with the preparation thereof, in U.S. Pat. Nos. 3,632,345; 3,928,041; 3,958,993; 3,961,959; 3,938,996; and 4,010,035; U.S. patent Ser. No. 589396 now patented No. 4,063,950; Japanese Laid-open-to public patent publications 50-125202; 50-147716; 51-105819; and 52-46817.

Representative examples of the DIR compounds will be given.

DIR-1: $\alpha$-{3-[$\alpha$-(2,4-di-t-amylphenoxy)butylamido]benzoyl}-$\alpha$-(2-aminophenoxyazoxy)-2-methoxyacetanilide DIR-2: $\alpha$-(1-phenyl-5-tetrazolylthio)-$\alpha$-pivaryl-2-chloro-5-[$\gamma$-(2,4-di-t-amylphenoxybutylamido]acetanilide DIR-3: $\alpha$-(4,7-dinitro-2-benzotriazolyl)-$\alpha$-pivaryl-3,6-dichloro-4-(N-methyl-N-octadecylsulfamyl)acetanilide DIR-4: $\alpha$-pivaryl-$\alpha$-[5-(3-methyl-2-benzothiazolinidene)amino-1-benzotriazonyl]-2-chloro-5-[$\gamma$-(2,4-di-t-amylphenoxy)butylamido]acetanilide DIR-5: 1-phenyl-3-[$\gamma$-(2,4-di-t-amylphenoxy)-butylamido]-4-(1-phenyl-5-tetrazolylthio)-5-pyrazolone DIR-6: 1-{4-[$\alpha$-(2,4-di-t-amylphenoxy)butylamido]-phenyl}-3-pyrrolidino-4-(diphenyl-5-tetrazolylthio)-5-pyrazolone DIR-7: 1-hydroxy-4-(1-phenyl-5-tetrazolylthio)-2'-tetradecyloxy-2-naphthanilide DIR-8: 5-methoxy-2-[$\alpha$-(3-n-pentadecylphenoxy)-butylamido]-4-(1-phenyl-5-tetrazolylthio)phenol DIR-9: 2-n-octadecyl-5-(1-phenyl-5-tetrazolylthio)hydroquinone DIR-10: 1,4-bis-chloroacetoxy-2-(1-phenyl-5-tetrazolylthio)benzene DIR-11: 2-(1-phenyl-5-tetrazolylthio)-4-(2,4-di-t-amylphenoxyacetamido)-1-indanone DIR-12: 2-(1-phenyl-5-tetrazolylthio)-4-octadecylsuccinimido-1-indanone DIR-13: 2-(1-phenyl-5-tetrazolylthio)-4-octadecylmethylthiosuccinimido-1-indanone DIR-14: 2-[5-(3-methyl-2-benzothiazolinidene)amino-1-benzotriazonyl]-4-octadecylmethylthiosuccinimido-1-indanone DIR-15: 2-(1-phenyl-5-tetrazolylthio)-6-(2,4-di-t-amylphenoxyacetamido)-1-indanoneoxime DIR-16: 4-(0-dodecyloxyphenyl)-5-(1-phenyl-5-tetrazolylthio)-2-oxazolinone DIR-17: 2-(5-methyl-2-benzotriazolyl)-5-decylcyclopentanonephenylhydrazide DIR-18: 3-(1-phenyl-5-tetrazolylthio)-1-n-dodecyl-4-piperidone DIR-19: 3-(1-phenyl-5-tetrazolylthio)oxyindole DIR-20: $\omega$-bromo-$\omega$-(1-phenyl-5-tetrazolylthio)-4-lauroylamidoacetophenone DIR-21: $\omega$-bromo-$\omega$-(1-phenyl-5-tetrazolylseleno)-4-lauroylaminoacetophenone DIR-22: $\alpha$-(1-phenyl-5-tetrazolylseleno)-N-octadecylacetamide.

The DIR compound is incorporated usually in an amount of $10^{-5}$ to $10^{-1}$ mole per mole of the silver halide. The most preferred light-sensitive material of the invention, i.e. the above mentioned light-sensitive color photographic material may contain a conventional four equivalent type coupler and a colored coupler.

After the seal is opened, the light-sensitive material of the invention is exposed and developed, depending on the respective utility, by the usual black and white negative or positive development, color negative development, or color reversal development. Further, it may be processed by the black and white or color diffusion transfer reversal method. It may be processed by the stabilizing treatment, after the development, with a solution containing chiefly ammonium thiocyanate or thiourea. It may also be processed by the single bath development-fixing method, processing with a developing solution containing a solvent for the silver halide.

In this invention, according to needs, there may be employed the combination use of a deoxygen agent and the sealing in which the package is completely sealed up at not more than 1/6 atmospheres of the oxygen partial pressure even though the deoxygen agent is used.

The invention is further illustrated and demonstrated by the following examples.

EXAMPLE 1

A highly-sensitive silver iodobromide emulsion containing 3 mole % silver iodide, prepared by the double jet method, was sensitized with gold and sulfur sensitizers and the resulting emulsion was divided. To 1 kg of the emulsion containing 1 mole silver halide was added a sensitizing dye of the invention as the $3\times10^{-4}$ mole methanol solution, as shown in Table 1. To each emulsion was added 4-hydroxy-6-methyl-1,3,3a,7-tetrazaindene, and emulsions were coated on cellulose acetate supports and dried, giving samples 2 to 20. As a control, sample 1 containing no sensitizing dye was prepared, following the above-mentioned conditions. Each sample was sealed up in full dark under the following conditions [1] to [6] and maintained for two years in an air-conditioned room at 30° C. and 55% relative humidity.

Seal condition [1]

The samples were allowed to stand in the following atmosphere: temperature, 23° C.; relative humidity, 55%, oxygen partial pressure, 1/5 atmosphere; nitrogen partial pressure, 4/5 atmosphere. Then, the samples were sealed up with low-density polyethylene receptacles (thickness, 1 mm; oxygen permeability, $1\times10^4$ cc/m$^2$.24 hrs.atm. at 20° C. and 0% relative humidity). The receptacle comprised a cylindrical body and a cap and the two were enchased each other with the screws. The reverse side of the cap contacting the fringe of the body was coated with a silicone compound.

Seal condition [2]

The samples were allowed to stand in the following atmosphere: temperature, 23° C.; relative humidity, 55%; oxygen partial pressure, 1/6 atmosphere; nitrogen partial pressure, 5/6 atmosphere. Then the samples were sealed up with non-plasticized polyvinyl chloride resin receptacles (thickness, 1.1 mm; oxygen permeability, $5\times10^2$ cc/m$^2$.24 hrs.atm. at 20° C., 0% relative humidity) in a tent containing the same atmosphere. The shape of the receptacle was identical with that in the above [1].

Seal condition [3]

The samples were allowed to stand in the following atmosphere: temperature, 23° C.; relative humidity, 55%; oxygen partial pressure, 1/10 atmosphere; nitrogen partial pressure, 9/10 atmosphere. Then, the samples were sealed up with Nylon/polypropylene receptacles (oxygen permeability, $1.5\times10^2$ cc/m$^2$.24 hrs.atm. at 20° C., 0% relative humidity) in a dry box containing the same atmosphere. The receptacle comprised a cylindrical body 715μ thick consisting of Nylon (115μ) and polypropylene (600μ), the body being heat-sealed with an inner seal for adhesion.

Seal condition [4]

The samples were allowed to stand in the following atmosphere: temperature, 23° C.; relative humidity, 55%; oxygen partial pressure, 1/50 atmosphere; nitrogen partial pressure, 49/50 atmosphere. The samples were sealed up with aluminum receptacles (oxygen permeability, 0 cc/m$^2$.24 hrs.atm. at 20° C., 0% relative humidity) in a dry box containing the same atmosphere. The receptacle comprised an aluminum cylindrical body heat-sealed with an inner seal consisting of aluminum (40μ) and ethylene/vinyl acetate copolymer (30μ).

Seal condition [5]

Using the aluminum receptacles described in the above [4], the samples were sealed up under the same conditions as in the above [1].

Seal condition [6]

Using the polyethylene receptacles described in the above [1], the samples were sealed up under the same conditions as in the above [4].

After two years storage, the samples were white light-exposed with a sensitometer (Type KS-1, available from Konishiroku Photo Ind.) through an optical wedge, and thereafter developed for 2 minutes with the following developing solution, at 30° C., fixed and washed.

Developing solution

| | |
|---|---|
| Metol | 3 g |
| anhydrous sodium sulfite | 50 g |
| hydroquinone | 6 g |
| sodium carbonate | 29.5 g |
| potassium bromide | 1 g |
| water | to make 1 liter. |

The characteristics curves of the silver images thus obtained were determined with an automatic densitometer (available from Konishiroku Photo Ind.), and the sensitivity of each material was calculated from the reciprocal number of exposure amount, necessary for giving the optical density of "fog+0.1". The proportions of the sensitivity by the seal conditions [2] to [4] according to the invention, or [5] and [6] outside the scope of the invention to that in the seal condition [1] according to the known art were worked out and the results are shown in Table 1.

TABLE 1

| Sample No. | Sensitizing dye | Sensitivity under seal condition [2] / Sensitivity under seal condition [1] | Sensitivity under seal condition [3] / Sensitivity under seal condition [1] | Sensitivity under seal condition [4] / Sensitivity under seal condition [1] | Sensitivity under seal condition [5] / Sensitivity under seal condition [1] | Sensitivity under seal condition [6] / Sensitivity under seal condition [1] |
|---|---|---|---|---|---|---|
| 1 | | 1.01 | 0.99 | 1.00 | 1.00 | 1.00 |
| 2 | illustrated sensitizing dye (1) | 1.52 | 1.68 | 1.98 | 1.02 | 0.99 |
| 3 | (3) | 1.65 | 1.74 | 2.01 | 1.01 | 1.02 |
| 4 | (5) | 1.54 | 1.62 | 1.85 | 1.04 | 1.01 |
| 5 | (8) | 1.79 | 1.95 | 2.14 | 1.02 | 0.98 |
| 6 | (9) | 1.82 | 1.99 | 2.20 | 1.00 | 1.01 |
| 7 | (14) | 1.52 | 1.64 | 1.85 | 1.03 | 1.00 |
| 8 | (15) | 1.64 | 1.70 | 2.05 | 0.99 | 1.02 |
| 9 | (57) | 1.75 | 1.92 | 2.25 | 1.01 | 0.99 |
| 10 | (22) | 2.15 | 2.43 | 2.78 | 1.05 | 1.01 |

TABLE 1-continued

| Sample No. | Sensitizing dye | Sensitivity under seal condition [2] / Sensitivity under seal condition [1] | Sensitivity under seal condition [3] / Sensitivity under seal condition [1] | Sensitivity under seal condition [4] / Sensitivity under seal condition [1] | Sensitivity under seal condition [5] / Sensitivity under seal condition [1] | Sensitivity under seal condition [6] / Sensitivity under seal condition [1] |
|---|---|---|---|---|---|---|
| 11 | (21) | 1.51 | 1.67 | 1.99 | 1.03 | 1.00 |
| 12 | (74) | 1.60 | 1.82 | 2.08 | 0.99 | 0.98 |
| 13 | (24) | 1.55 | 1.80 | 1.98 | 1.04 | 1.02 |
| 14 | (25) | 1.48 | 1.70 | 1.94 | 1.02 | 0.99 |
| 15 | (71) | 1.52 | 1.65 | 1.94 | 1.04 | 1.01 |
| 16 | (19) | 1.29 | 1.41 | 1.62 | 1.03 | 1.00 |
| 17 | (30) | 1.35 | 1.50 | 1.68 | 1.01 | 0.98 |
| 18 | (31) | 1.27 | 1.38 | 1.50 | 0.99 | 1.02 |
| 19 | (33) | 1.35 | 1.52 | 1.68 | 1.05 | 1.01 |
| 20 | (36) | 1.30 | 1.45 | 1.52 | 1.02 | 1.00 |

As clearly shown in Table 1, the difference of sensitivities between the materials under the seal condition [1] according to the known art and those under the seal conditions [2] to [4] according to the invention is not significant, and no improvement in preservability is observed at all, if the materials contain no light-sensitive dye. In contrast thereto, a remarkable improvement in preservability may be observed under the seal conditions [2] to [4] as compared with under the seal condition [1], if the materials contain the sensitizing dye of the invention. It is also shown clearly that the use of a package material having a lower oxygen partial pressure brings about better improvement of preservability. Further, as the results obtained under the seal conditions [5] and [6], the intended effects of the invention may not be achieved, if any essential element of the invention is absent in the package.

EXAMPLE 2

A highly-sensitive silver iodobromide emulsion containing 7 mole % silver iodide, prepared by the double jet method, was sensitized with gold and sulfur sensitizers and then color-sensitized by the addition of $3\times10^{-4}$ mole methanol solution based on 1 mole silver halide, of illustrated sensitizing dye D-(12). To the emulsion was added 4-hydroxy-6-methyl-1,3,3a,7-tetrazaindene, and the emulsion was divided into 1 mole silver halide units. To each emulsion were added a dispersion containing a coupler and/or DIR compound listed in Table 2. After addition of a hardener and a surfactant, each emulsion was coated on a cellulose triacetate support and dried, giving samples 21 to 35. The coupler and the DIR compound were mixed with an equivalent weight of tricresyl phosphate to each weight of the compounds, then with three equivalents weight of ethyl acetate and dissolved thoroughly by heating and resulting mixture at 60° C. The solution was mixed with 50 ml of 10% aqueous solution of Alkanol B (registered trademark, alkylnaphthalene sulfonate, available from Du Pont) and 700 ml of 10% aqueous solution of gelatin, and the resulting mixture was dispersed with a colloid mill, affording each dispersion. Each sample was sealed up under the seal conditions [1] or [4] as in Example 1 and stored for one year in an air-conditioned room at 40° C. and 55% relative humidity. After the storage, each sample was wedge-exposed through a yellow filter, following similar procedures as in Example 1, and processed by the following procedures.

| Process (at 37.8° C.) | Period |
|---|---|
| color development | 3 min. 15 sec. |
| bleaching | 6 min. 30 sec. |
| washing | 3 min. 15 sec. |
| fixing | 6 min. 30 sec. |
| washing | 3 min. 15 sec. |
| stabilization | 1 min. 30 sec. |
| drying | |

The processing solutions used in the above processes had the following compositions:

| | |
|---|---|
| Color developing solution: | |
| 4-amino-3-methyl-N-ethyl-N-(β-hydroxyethyl)aniline sulfate | 4.8 g |
| anhydrous sodium sulfite | 0.14 g |
| hydroxylamine ½ sulfate | 1.98 g |
| sulfuric acid | 0.74 g |
| anhydrous potassium carbonate | 28.85 g |
| anhydrous potassium hydrogencarbonate | 3.46 g |
| anhydrous potassium sulfite | 5.10 g |
| potassium bromide | 1.16 g |
| sodium chloride | 0.14 g |
| trisodium nitrilotriacetate monohydrate | 1.20 g |
| potassium hydroxide | 1.48 g |
| water | to make 1 liter. |
| Bleaching solution: | |
| ferric ammonium EDTA | 100.0 g |
| biammonium EDTA | 10.0 g |
| ammonium bromide | 150.0 g |
| glacial acetic acid | 10.0 ml |
| water | to make 1 liter |
| (adjusted to pH 6.0 with aqueous ammonia solution). | |
| Fixing solution: | |
| ammonium thiosulfate | 175.0 g |
| anhydrous sodium sulfite | 8.6 g |
| sodium metasulfite | 2.3 g |
| water | to make 1 liter |
| (adjusted to pH 6.0 with acetic acid) | |
| Stabilizing solution: | |
| formalin | 1.5 ml |
| Konidax (available from Konishiroku Photo Ind.) | 7.5 ml |
| water | to make 1 liter |

The fog and the sensitivity of the thus obtained Magenta color development were measured and the results are shown in Table 2.

The sensitivity is indicated by the relative value of each sample to the sensitivity 100 immediately after the coating on the same day.

TABLE 2

| Sample No. | Composition of dispersion: Coupler (illustrated compound) | Composition of dispersion: DIR compound (illustrated compound) | Characteristic before storage: Fog | Characteristic before storage: Sensitivity | Characteristic after one year storage, Seal condition [1]: Fog | Seal condition [1]: Sensitivity | Seal condition [4]: Fog | Seal condition [4]: Sensitivity |
|---|---|---|---|---|---|---|---|---|
| 21 | M'-18 × $10^{-2}$ mole | — | 0.15 | 100 | 0.27 | 70 | 0.17 | 94 |
| 22 | M'-3 × $10^{-2}$ mole | — | 0.15 | 100 | 0.25 | 68 | 0.16 | 97 |
| 23 | M-1 × $10^{-2}$ mole | — | 0.17 | 100 | 0.32 | 51 | 0.18 | 98 |
| 24 | M-2 × $10^{-2}$ mole | — | 0.16 | 100 | 0.34 | 48 | 0.17 | 94 |
| 25 | M-15 × $10^{-2}$ mole | — | 0.17 | 100 | 0.35 | 49 | 0.18 | 101 |
| 26 | M-8.4 × $10^{-2}$ mole | — | 0.18 | 100 | 0.40 | 46 | 0.20 | 95 |
| 27 | M-9 × $10^{-2}$ mole | — | 0.13 | 100 | 0.30 | 50 | 0.13 | 97 |
| 28 | M'-1.8 × $10^{-2}$ mole | DIR-54.5 × $10^{-3}$ mole | 0.13 | 100 | 0.23 | 40 | 0.13 | 94 |
| 29 | M'-1 × $10^{-2}$ mole | DIR-57 × $10^{-3}$ mole | 0.12 | 100 | 0.21 | 41 | 0.13 | 97 |
| 30 | M'-1 × $10^{-2}$ mole | DIR-24 × $10^{-3}$ mole | 0.13 | 100 | 0.22 | 37 | 0.14 | 93 |
| 31 | M'-1 × $10^{-2}$ mole | DIR-47 × $10^{-3}$ mole | 0.14 | 100 | 0.27 | 35 | 0.14 | 92 |
| 32 | M-1 × $10^{-2}$ mole | DIR-57 × $10^{-3}$ mole | 0.14 | 100 | 0.24 | 32 | 0.15 | 98 |
| 33 | M-4 × $10^{-2}$ mole | DIR-18 × $10^{-3}$ mole | 0.13 | 100 | 0.26 | 28 | 0.13 | 95 |
| 34 | M-10 × $10^{-2}$ mole | DIR-87 × $10^{-3}$ mole | 0.14 | 100 | 0.27 | 25 | 0.16 | 97 |
| 35 | M-12 × $10^{-2}$ mole | DIR-70 × $10^{-3}$ mole | 0.13 | 100 | 0.25 | 30 | 0.14 | 100 |

As clearly shown in Table 2, when a two equivalent coupler and/or a DIR compound were added to an emulsion optically sensitized with a sensitizng dye, the quality degradation thereof became severe during storage under the conventional package conditions. In contrast thereto, the material showed almost no change in fog and sensitivity under the package conditions according to the invention, proving the outstanding improved effects in preservability.

The results show that the invention is effective for light-sensitive color photographic materials containing a two equivalent coupler and/or a DIR compound, particularly a DIR compound.

EXAMPLE 3

On a support comprising an under-coated, transparent cellulose triacetate base, the following layers were coated, in turn, on the support, giving a multi-layers sample 1 which is a highly-sensitive multi-layers light-sensitive color negative photographic material.

First layer: halation-preventing layer

A gelatin solution containing a black colloidal silver was coated in an amount of 0.3 g of silver per $m^2$ (dry film thickness: 3μ).

Second layer: intermediate layer

An aqueous gelatin solution was coated (dry film thickness: 1μ).

Third layer: red-sensitive, low-sensitive silver halide emulsion layer

A silver iodobromide emulsion containing 4 mole % silver iodide (mean grain size: 0.4μ) was chemically sensitized with gold- and sulfur-sensitizers. The emulsion was then optically sensitized with 0.25 g of the illustrated compound D-(16) and 0.06 g of the illustrated compound D-(17) per mole silver halide as the red-sensitive sensitizing dyes, and further added 1 g of 4-hydroxy-6-methyl-1,3,3a,7-tetrazaindene, 40 mg of 1-phenyl-5-mercaptotetrazole and a cyan coupler dispersion-1. The thus obtained red-sensitive, low-sensitive silver halide emulsion was coated in an amount of 18 g of silver per $m^2$ (dry film thickness: 3.8μ).

Fourth layer: red-sensitive, high-sensitive silver halide emulsion layer

A silver iodobromide containing 7 mole % silver iodide (mean grain size: 1.2μ) was chemically sensitized with gold- and sulfur-sensitizers. The emulsion was optically sensitized with 0.13 g of the illustrated compound D-(16) and 0.03 g of the illustrated compound D-(17) per mole silver halide as the red-sensitive sensitizing dyes, then added 1 g of 4-hydroxy-6-methyl-1,3,3a,7-tetrazaindene and 12 mg of 1-phenyl-5-mercaptotetrazole, and finally a cyan coupler dispersion-2. The thus obtained red-sensitive, high-sensitive silver halide emulsion was coated in an amount of 10 g of silver per $m^2$ (dry film thickness: 2μ).

Fifth layer: intermediate layer identical with the second layer

Sixth layer: green-sensitive, low-sensitive silver halide emulsion layer

A silver iodobromide emulsion containing 5 mole % silver iodide (mean grain size: 0.8μ) was chemically sensitized with gold- and sulfur-sensitizers. The emulsion was color-sensitized with 0.11 g of the illustrated compound D-(11), 0.08 g of the illustrated compound D-(12) and 0.09 g of the illustrated compound D-(80) per mole silver halide as the green-sensitive sensitizing dyes, then added 1 g of 4-hydroxy-6-methyl-1,3,3a,7-tetrazaindene and 40 mg of 1-phenyl-5-mercaptotetrazole, and finally a Magenta coupler dispersion-1. The thus obtained green-sensitive, low-sensitive silver halide emulsion was coated in an amount of 14 g of silver per $m^2$ (dry film thickness: 4μ).

Seventh layer: green-sensitive, high-sensitive silver halide emulsion layer

A silver iodobromide containing 7 mole % silver iodide (mean grain size: 1.2μ) was chemically sensitized with gold- and sulfur-sensitizers. The emulsion was color-sensitized with 0.09 g of the illustrated compound D-(11), 0.07 g of the illustrated compound D-(12) and 0.08 g of the illustrated compound D-(80) per mole silver halide as the green-sensitive sensitizing dyes, then added 1 g of 4-hydroxy-6-methyl-1,3,3a,7-tetrazaindene and 10 g of 1-phenyl-5-mercaptotetrazole, and finally a Magenta coupler dispersion-2.

The thus obtained green-sensitive, high-sensitive silver halide emulsion was coated in an amount of 12 g of silver per $m^2$ (dry film thickness: 1.8μ).

Eighth layer: intermediate layer identical with the second layer.

Ninth layer: yellow filter layer

An aqueous solution of gelatin containing yellow colloidal silver and 2,5-di-t-octyl-hydroquinone dispersion was coated in an amount of 0.1 g of silver per $m^2$.

Tenth layer: blue-sensitive, low-sensitive silver halide emulsion layer

A silver iodobromide solution containing 8 mole % silver iodide (mean grain size: 0.6μ) was chemically sensitized with gold- and sulfur-sensitizers. The emulsion was added 1 g of 4-hydroxy-6-methyl-1,3,3a,7-tetrazaindene, 80 mg of 1-phenyl-5-mercaptotetrazole and 2 g of 1,2-bisvinylsulfonylethane, and finally a yellow coupler dispersion.

The thus obtained blue-sensitive, low-sensitive silver halide emulsion was coated in an amount of 5 g of silver per $m^2$.

Eleventh layer: blue-sensitive, high-sensitive silver halide emulsion layer

A silver iodobromide emulsion containing 7 mole % silver iodide (mean grain size: 1.2μ) was chemically sensitized with gold- and sulfur-sensitizers. The emulsion was added 60 g of 4-hydroxy-6-methyl-1,3,3a,7-tetrazaindene, 2 g of 1,2-bisvinylsulfonethane, and finally a yellow coupler dispersion. The thus obtained blue-sensitive, high-sensitive silver halide emulsion was coated in an amount of 7 g of silver per $m^2$ (dry film thickness: 3μ).

Twelfth layer: protective layer

An aqueous solution of gelatin containing 1,2-bisvinylsulfonethane was coated (dry film thickness: 1.2μ).

A multi-layers sample-2 was also prepared following the same procedures as in above-mentioned sample 1, except that the cyan coupler dispersion-2 and the Magenta coupler dispersion-2 employed in the fourth and seventh layers of the multi-layers sample-1 were replaced with a cyan coupler dispersion-3 and a Magenta coupler dispersion-3, respectively, and that 0.12 g of the illustrated compound D-(86) was added to the tenth and eleventh layers in each occurrence as the blue-sensitive sensitizing dye, after the chemical sensitization.

The coupler dispersions employed in the third, fourth, sixth, seventh, tenth and eleventh layers were prepared as follows:

Cyan coupler dispersion-1:

39 g of the illustrated compound (c'-1) as the cyan coupler, 2 g of the illustrated compound (cc-4) as the colored coupler and 2.5 g of the illustrated compound (DIR-57) as the DIR compound were dissolved in a mixture of 22 g of tricresyl phosphate and 140 g of ethyl acetate. The resulting solution was added into 450 ml of 7.5% gelatin solution containing 1.5 g of Alkanol B, and the whole mixture was emulsion-dispersed with a colloid mill.

Cyan coupler dispersion-2

45 g of the illustrated compound (C-1) as the cyan coupler, 2 g of the illustrated compound (C-2) as the colored coupler, 2.5 g of the illustrated compound (DIR-12) as the DIR compound and 0.5 g of lauryl gallate were dissolved in a mixture of 25 g of tricresyl phosphate and 150 g of ethyl acetate. The resulting solution was added into 480 ml of 7.5% gelatin solution containing 1.7 g of Alkanol B, and the whole mixture was emulsion-dispersed with a colloid mill.

Cyan coupler dispersion-3:

30 g of the illustrated compound (c-3) as the cyan coupler, 2 g of the illustrated compound (C-2) as the colored coupler, 4 g of the illustrated compound (DIR-7) as the DIR compound and 0.5 g of lauryl gallate were dissolved in a mixture of 18 g of tricresyl phosphate and 110 g of ethyl acetate. The resulting solution was added into 350 ml of 7.5% gelatin solution containing 1.4 g of Alkanol B, and the whole mixture was emulsion-dispersed with a colloid mill.

Magenta coupler dispersion-1:

50 g of the illustrated compound (M-1) as the Magenta coupler, 10 g of the illustrated compound (C-4) as the colored coupler and 1.5 g of the illustrated compound (DIR-12) as the DIR compound were dissolved in a mixture of 60 g of tricresyl phosphate and 180 g of ethyl acetate. The resulting solution was added into 670 ml of 7.5% gelatin solution containing 2 g of Alkanol B, and the whole mixture was emulsion-dispersed with a colloid mill.

Magnet coupler dispersion-2:

10 g of the illustrated compound (M-1) as the Magenta coupler, 2.9 g of the illustrated compound (C-5) as the colored coupler and 1 g of 2,4-di-t-octylhydroquinone were dissolved in a mixture of 20 g of tricresyl phosphate and 45 g of ethyl acetate. The resulting solution was added into 170 ml of 7.5% gelatin solution containing 2 g of Alkanol B, and the whole mixture was emulsion-dispersed with a colloid mill.

Magenta coupler dispersion-3:

10 g of the illustrated compound (M-2) as the Magenta coupler, 2.9 g of the illustrated compound (C-4) as the colored coupler and 1 g of the illustrated compound (DIR-6) as the DIR compound were dissolved in a mixture of 14 g of diethyl laurylamide, 14 g of triscresyl phosphate and 45 g of ethyl acetate.

The resulting solution was added into 200 ml of 7.5% gelatin solution containing 2.5 g of Alkanol B, and the whole mixture was emulsion-dispersed with a colloid mill.

Yellow coupler dispersion:

200 g of the illustrated compound (Y-1) as the yellow coupler were dissolved in a mixture of 100 g of dibutyl phosphate and 560 g of ethyl acetate. The resulting solution was added into 1500 ml of 7.5% gelatin solution containing 22 g of Alkanol B, and the whole mixture was emulsion-dispersed with a colloid mill.

The thus obtained multi-layers samples were packed under the seal condition [1] as in Example 1 and the undermentioned seal condition [4'] and [4''], and thereafter stored for 2 years in an air-conditioned room at 30° C. and 55% relative humidity. Each sample was exposed and developed under the same conditions as in Example 1.

The sensitivity and γ (indicated by tan θ of the characteristics curve) of each of the cyan image, Magenta image and yellow image formed on each sample was measured at 434 nm, 547 nm and 651 nm, respectively and the results are shown in Table 3.

The sensitivity is indicated by the relative value of each sample to the sensitivity 100 immediately after the coating.

The seal condition [4'] is as follows:

The samples were allowed to stand in a chamber under the conditions at 23° C., 55% relative humidity, 1/20 atm. oxygen partial pressure, 19/20 atm. nitrogen partial pressure, and 1 atm. total pressure. The chamber was evacuated to 1/10 atm. with a rotary pump and the samples were sealed up under the condition with aluminum receptacles of seal condition [4].

TABLE 3

| Multi-layers Sample No. | | Characteristics before storage | | | Characteristics after 2 years storage | | | | | |
|---|---|---|---|---|---|---|---|---|---|---|
| | | | | | Seal condition [1] | | | Seal condition [4'] | | |
| | | Sensitivity | γ | γ Balance | Sensitivity | γ | γ Balance | Sensitivity | γ | γ Balance |
| | B | 100 | 0.72 | B/G = 1.16 | 92 | 0.72 | B/G = 1.50 | 90 | 0.73 | B/G = 1.17 |
| 1 | G | 100 | 0.62 | | 65 | 0.49 | | 95 | 0.62 | |
| | R | 100 | 0.54 | R/G = 0.87 | 71 | 0.55 | R/G = 1.12 | 93 | 0.54 | R/G = 0.87 |
| | B | 100 | 0.73 | B/G = 1.14 | 60 | 0.60 | B/G = 0.97 | 97 | 0.72 | B/G = 1.13 |
| 2 | G | 100 | 0.64 | | 51 | 0.62 | | 96 | 0.64 | |
| | R | 100 | 0.55 | R/G = 0.86 | 45 | 0.40 | R/G = 0.65 | 97 | 0.55 | R/G = 0.86 |

As clearly shown in Table 3, highly-sensitive, multilayers light-sensitive color negative photographic materials containing a sensitizing dye caused, during storage, reduction of sensitivity and change in γ-balance, and thus lost their original characteristics of light-sensitive color negative materials. In contrast thereto, almost no degradation of qualitites was observed and the initial characteristics were maintained, after storage, when they were sealed up under the seal conditions of the invention.

EXAMPLE 4

Multilayered samples 1 and 2 described in Example 3 were sealed up in packages under the condition [1] in Example 1 or sealing-up condition [7] or [8] as defined later.

After incubation for two years under a condition at 35° C. and 60% relative humidity, these samples were exposed, developed and measured for sensitivities and γ in the same way as Example 3. The result is shown in Table 4, wherein S and GB represent sensitivity and γ balance, respectively, and the sensitivity is shown as relative sensitivity assuming the sensitivity of one of the samples without incubation being 100 .

Seal condition [7]

After standing in the atmosphere at 23° C.; and relative humidity 55%; the samples and 4 g of an active iron oxide deoxygen agent were sealed up by a bag made of biaxially stretched polypropylene of 20μ thickness, polyvinilidenechloride of 3μ thickness and polyethylene of 50μ thickness. The incorporated air in the bag was of 30 cc.

After two years the oxygen partial pressure in the bag was 1/30 atm.

Seal condition [8]

After standing at 23° C.; and relative humidity, 55%; the samples and 4 g of an active iron oxide deoxygen agent were sealed up in an aluminum receptacle, wherein 30 cc of air was incorporated.

After two years, the oxygen partial pressure was 1/100 atm.

EXAMPLE 5

A highly-sensitive, light-sensitive color reversal material tolerant of changes in color temperature of the light source was prepared. Namely, two species of silver iodobromide emulsions each having mean grain size of 0.7μ or 1.2μ and containing 6 mole % silver iodide were prepared in accordance with a method described in Japanese Laid-open-to-Public Patent Publication 48-65925. Each emulsion was matured chemically with hypo and chloroauric acid.

95 mg of the illustrated compound (D-58), 65 mg of the illustrated compound (D-16) and 6 mg of the illustrated compound (D-17) were added to each emulsion as sensitizing dyes based on 1 mole silver halide (the unit of addition is hereinafter referred to, unless otherwise defined) to give the red sensitivity.

As stabilizers, 1.5 g of 4-hydroxy-6-methyl-1,3,3a,7-tetrazaindene, 30 mg of 1-phenyl-5-mercaptotetrazole and 9 g of polyvinylpyrrolidone were added. 15 mole % cyan couplers (C-1) (C-6) (=1) were added and dispersed. Further 240 g in total of empty gelatin and a hardener were added to each emulsion. On a triacetate film were coated, in turn, an under-coat layer, halation-preventing layer and a gelatin layer. On the layers, each of the redsensitive emulsion prepared above was double-coated such that the under layer contains grains having the mean grain size of 0.7μ; the upper layer contains grains having the mean grain size of 1.2μ; and the film contains each emulsion so as to contain each 8 mg of the silver per 100 $cm^2$.

Further, on the film was coated a liquid containing 30 g of empty gelatin and a surface active agent to make 1 liter of the liquid, in an amount of 1 g of gelatin per $m^2$.

Similarly, silver iodobromide emulsions having mean grain sizes of 0.5μ and 1.0μ, respectively, were prepared following the method in the red-sensitive emulsions, in order to obtain green-sensitive emulsion. The emulsion were matured chemically with hypo and chloroauric acid. In order to give the green sensitivity, 180 mg of the illustrated compound (D-12) and 90 mg of the illustrated compound (D-80) were added. Stabilizers and other additives were added in the same way as in the red-sensitive layer emulsion, except couplers.

TABLE 4

| Sample No. | | Without incubation | | | Two years incubation | | | | | | | | |
|---|---|---|---|---|---|---|---|---|---|---|---|---|---|
| | | | | | Seal condition [1] | | | Seal condition [7] | | | Seal condition [8] | | |
| | | S | γ | GB | S | γ | GB | S | γ | GB | S | γ | GB |
| | B | 100 | 0.72 | B/G = 1.16 | 85 | 0.70 | B/G = 1.55 | 91 | 0.70 | G/B = 1.15 | 93 | 0.73 | B/G = 1.18 |
| 1 | G | 100 | 0.62 | | 52 | 0.45 | | 94 | 0.61 | | 96 | 0.62 | |
| | R | 100 | 0.54 | R/G = 0.87 | 60 | 0.52 | R/G = 1.16 | 92 | 0.53 | R/G = 0.87 | 94 | 0.54 | R/G = 0.87 |
| | B | 100 | 0.73 | B/G = 1.14 | 52 | 0.52 | B/G = 1.21 | 95 | 0.72 | B/G = 1.14 | 98 | 0.73 | B/G = 1.14 |
| 2 | G | 100 | 0.64 | | 38 | 0.43 | | 96 | 0.63 | | 97 | 0.64 | |
| | R | 100 | 0.55 | R/G = 0.86 | 40 | 0.46 | R/G = 1.07 | 94 | 0.55 | R/G = 0.87 | 99 | 0.55 | R/G = 0.86 |

As shown in Table 4, the samples sealed up with deoxygen agent keep their photographic characteristic well, even under hard incubation.

15 mole % Magenta couplers (M-1) and (M-3) were added in the form of a dispersion. The emulsions were coated on the samples coated previously with the above-mentioned redsensitive layers and others, such that each silver amount of the emulsions was 8 mg per $m^2$.

Upon the thus obtained samples was coated a yellow colloid layer.

Following this, a blue-sensitive layer emulsion was prepared. Namely, a silver halide emulsion having a mean grain size of 1.3μ was prepared, matured chemically and added 150 mg of the illustrated compound (D-1). Other additives used were identical with those used in other layers mentioned above, except couplers. 30 mole % couplers (Y-2) and (Y-1) were added as the under-mentioned dispersions.

On the yellow colloid layers were coated the above-mentioned two species of coating solutions such that the silver amount of the blue-sensitive emulsion was 10 mg per 100 $cm^2$ and the gelatin amount of the protective layer was 1.2 $g/m^2$, giving a color-sensitive material. The material thus obtained was divided into two, each of which was sealed up, following the under-mentioned conditions:

Seal condition [9]:

Into a trigonal seal bag comprising a Kraft paper of 60μ thick and a carbon black-darkened low-density polyethylene of 60μ, from the outside (0% relative humidity, 20° C., $2\times10^6$ $cc/m^2$0.24 hrs.atm.), samples were placed in air and heat-sealed.

Seal condition [10]:

Into a trigonal seal bag comprising cellophane of 30μ thick, aluminum of 20μ thick and a carbon black-darkened low-density polyethylene of 50μ thick, from the outside (0% relative humidity, 20° C., 0 $cc/m^2$0.24 hrs.atm.), samples were placed in a dry box having an atmosphere of 1/20 atm. oxygen partial pressure and 19/20 nitrogen partial pressure, and then heat-sealed.

The sealed samples were allowed to stand for two years in air.

After one year had passed, the packages were opened and the samples were light-exposed, processed, following the under-mentioned procedures and the maximum density thereof was determined in the same way as in Example 3.

| Process (at 38° C.) | Period |
|---|---|
| first development | 3 min. |
| first stopping | 30 sec. |
| washing | 1 min. |
| color development | 5 min. |
| second stopping | 30 sec. |
| washing | 1 min. |
| bleaching | 6 min. |
| fixing | 6 min. |
| washing | 3 min. |
| stabilization | 30 sec. |
| First developing solution: | |
| sodium polyphosphate | 2.0 g |
| anhydrous sodium bisulfite | 8.0 g |
| phenidone | 0.35 g |
| sodium sulfite | 37.0 g |
| hydroquinone | 5.5 g |
| sodium carbonate | 33.0 g |
| sodium thiocyanate(10% aq. soln.) | 13.8 ml |
| sodium bromide | 1.3 g |
| potassium iodide(0.1% aq. soln.) | 13.0 ml |
| water | to make 1 liter (adjusted to pH 9.6 ± 0.1) |
| First and second stopping solutions: | |
| sodium hydroxide | 1.77 g |

-continued

| | |
|---|---|
| glacial acetic acid | 30.0 ml |
| water | to make 1 liter (adjusted to pH 3.8) |
| Color developing solution: | |
| sodium polyphosphate | 5.0 g |
| benzyl alcohol | 4.5 ml |
| sodium sulfite | 7.5 g |
| trisodium phosphate dodecahydrate | 36.0 g |
| sodium bromide | 0.9 g |
| potassium iodide(0.1% aq. soln.) | 90.0 ml |
| 4-amino-N-ethyl-N-(β-methanesulfonamidoethyl)-m-toluidine sesquisulfate monohydrate | 11.0 g |
| ethylene diamine | 3.0 g |
| t-butylaminoboranhydride | 0.07 g |
| water | to make 1 liter (adjusted to pH 11.65 ± 0.1 with sodium hydroxide) |
| Bleaching solution: | |
| ferric ammonium EDTA | 170 g |
| ammonium bromide | 300 g |
| water | to make 1 liter (adjusted to pH = 5.8–6.0) |
| Fixing solution: | |
| anhydrous sodium thiosulfate | 94.5 g |
| anhydrous sodium bisulfite | 17.6 g |
| anhydrous disodium hydrogenphosphate | 15.0 g |
| water | to make 1 liter (adjusted to pH 5.9 ± 0.2) |
| Stabilizing solution: | |
| polyethylene oxide | 0.15 g |
| formaldehyde (37.5% soln.) | 6.0 g |
| water | to make 1 liter |

The results obtained are shown in Table 5.

TABLE 5

| | Before storage (initial) | After two years storage | |
|---|---|---|---|
| | | Seal [7] | Seal [8] |
| B | 3.18 | 2.60 | 3.18 |
| G | 3.20 | 2.70 | 3.19 |
| R | 3.22 | 2.50 | 3.10 |

As clearly shown in Table 5, the invention provides satisfactory results.

EXAMPLE 6

To a mixture of 200 parts by weight of polyethylene (mean molecular weight, 100,000; density, 0.95) and 20 parts by weight of polyethylene (mean molecular weight, 2,000; density, 0.80) were added 6.8% by weight of titanium oxide, and the mixture was coated by the extrusion-coating method on the surface of a fine quality paper, giving a covering layer of 0.035 mm thick.

The reverse side of the paper was coated with polyetylene to give a covering layer of 0.040 mm thick, thus giving a support of the invention.

After the polyethylene-coated surface of the support was pre-processed by the corona discharge, the support was coated, in turn, with the first layer or a blue-sensitive silver halide photographic emulsion layer containing a yellow dye-forming coupler, the second layer or an intermediate gelatin layer, the third layer or a green-sensitive silver halide photographic emulsion layer containing a Magenta dye-forming coupler, the fourth layer or an intermediate gelatin layer, the fifty layer or a red-sensitive silver halide emulsion layer containing a blue dye-forming coupler, and finally the sixth layer or protective gelatin layer, giving a multi-layers light-sensitive silver halide color photographic material.

Upon coating the layers, the amount of addition of ultraviolet absorber and the layers in which the same was added have been varied, as shown in Table 3, giving 16 species of samples. Of the six photographic element layers composing the sample, at 4% gelatin aqueous solution containing suitable amounts of a hardener and a coating aid was used for the second, fourth and sixth gelatin layers, affording gelatin amounts, after drying, of 1.0 g/m$^2$ for the second layer and 2.0 g/m$^2$ for the fourth and sixth layers, respectively.

The photographic emulsion used for the first layer was a silver chloroiodobromide gelatin emulsion comprising 1 mole % silver iodide, 9 mole % silver chloride and 90 mole % silver bromide, and further it contained a blue-sensitizing dye (D-81) in an amount of $2.5\times10^{-4}$ mole per mole silver halide in order to impart the blue sensitivity. To the photographic emulsion was added a dispersion in dibutyl phthalate comprising 0.2 mole per mole silver halide of α-[4-(1-benzyl-2-phenyl-3,5-dioxo-1,2,4-triazolinydyl)]-α-pivaryl-2-chloro-5-[γ-(2,4-di-t-amylphenoxy)butyrylamino]-acetanilide as a yellow dye-forming coupler and 0.15 mole per mole the aforesaid coupler of 2,5-di-t-octylhydroquinone as a color pollution-preventing agent, and the resulting emulsion was coated.

The photographic emulsion used for the third layer was prepared first by adding a dispersion of 0.2 mole per mole silver halide of 4,4'-benzylidenebis-[1-(2,4,6-trichlorophenyl)-3-{2-chloro-5-[γ-(2,4-di-t-amylphenoxy)butyrylamido]anilino}-5-pyrazolone] in a 2:1 mixture of butyl phthalate and tricresyl phosphate, and then by adding a dispersion comprising 0.3 mole per mole the aforesaid coupler of 2,5-di-t-octylhydroquinone as a color pollution-preventing agent and 0.5 mole per mole the aforesaid coupler of 2,2,4-trimethyl-6-lauryloxy-7-t-octylcumarone as an antioxidant in the same dispersant to a silver chlorobromide emulsion made green-sensitive with the cyanide dye (D-83) and the emulsion thus prepared was coated.

The photographic emulsion used for the fifth layer was the silver chlorobromide emulsion containing 90 mole % silver bromide prepared following the method described in Example 1, to which $2.5\times10^{-4}$ mole per mole silver halide of a red-sensitizing dye (D-84) was added to impart the red sensitivity. To the emulsion was added a dispersion, in dibutyl phthalate, of 0.2 mole per mole silver halide of 2,4-dichloro-3-methyl-6-[γ-(2,4-di-t-amylphenoxy)butyrylamido]phenol as a blue dye-forming coupler and 0.1 mole per mole the aforesaid coupler of 2,5-di-t-octylhydroquinone as a color pollution-preventing agent; and the thus obtained material was coated. Incidentally, the above-mentioned photographic emulsions were sulfur-sensitized with sodium thiosulfate and further contained suitable amounts of 4-hydroxy-6-methyl-1,3,3a,7-tetrazaindene as a stabilizer, bis(vinylsulfonylmethyl)ether as a hardener and saponin as a coating aid.

The material thus obtained was divided into two and one of them was placed, in an ambient air, in a trigonal seal package and the package was heat-sealed.

The package used comprised an unbleached Kraft paper of 120μ thick, aluminum of 12μ thick and a carbon black-darkened polyethylene of 50μ from the outside and had an oxygen permeability of 0 cc/m$^2$.24 hrs.atm. at 20° C., 0% relative humidity.

Another material was placed in a package having the same composition as above, and the package was heat-sealed, while substituting the air with nitrogen by the gas flash method. The oxygen partial pressure was then 2/100 atm. The two sealed packages were allowed to stand for one year under a natural condition after which the packages were opened.

The two samples were white light-exposed with a sensitometer (Type KS-7, available from Konishiroku Photo Ind.) through an optical wedge and thereafter color-developed according to the following procedures:

| Process (at 31° C.) | Period |
|---|---|
| color-development | 3 min. |
| bleach-fixing | 1 min. |
| washing | 2 min. |
| stabilization | 1 min. |
| washing | 10 min. |
| drying (below 95° C.) | |

The processing solutions employed in the above-mentioned processes had the following compositions.

| | |
|---|---|
| Color-developing solution: | |
| N-ethyl-N-β-methanesulfonamidoethyl 3-methyl-4-aminoaniline sulfate | 4.0 g |
| hydroxylamine | 2.0 g |
| potassium carbonate | 25.0 g |
| sodium chloride | 0.1 g |
| sodium bromide | 0.2 g |
| anhydrous sodium sulfite | 2.0 g |
| benzyl alcohol | 10.0 ml |
| polyethylene glycol (mean polymerization degree, 400) | 3.0 ml |
| Bleach-fixing solution: | |
| ferric sodium EDTA | 60.0 g |
| ammonium thiosulfate | 100 g |
| sodium bisulfite | 10.0 g |
| sodium metabisulfite | 3.0 g |
| water | to make 1 liter (adjusted to pH = 6.6 with aqueous ammonia solution). |
| Stabilizing solution: | |
| succinic acid | 10.0 g |
| formalin (37% aq. soln.) | 15.0 g |
| add water and sodium acetate, adjust to pH 3.9 and add water to make 1 liter. | |

The reflective densities of dye images formed on each sample were measured with a photoelectric densitometer (Type PDA-60, available from Konishiroku Photo Ind.) and the characteristics value, i.e., fog, sensitivity and gradation, were determined. The results are shown in Table 6.

TABLE 6

| Oxygen partial pressure | | Before storage (initial) | | | After one year storage | | |
|---|---|---|---|---|---|---|---|
| | | B | G | R | B | G | R |
| 1/5 atm. | S | 135 | 118 | 113 | 72 | 104 | 91 |
| | γ | 3.15 | 3.05 | 3.00 | 3.40 | 2.70 | 2.67 |
| | γ-balance | 1.03 (B/G) | | 0.98 (R/G) | 1.25 (B/G) | | 0.98 (R/G) |
| 1/50 atm. | S | 135 | 118 | 113 | 134 | 118 | 112 |
| | γ | 3.15 | 3.05 | 3.00 | 3.16 | 3.05 | 2.98 |
| | γ-balance | 1.03 (B/G) | | 0.98 (R/G) | 1.04 (B/G) | | 0.98 (R/G) |

As clearly shown in Table 6, superior effects may be obtained solely by the present invention.

EXAMPLE 7

A silver chloroiodobromide emulsion was prepared according to the usual ammonia method by mixing-pressing ammonium hexachloroiridate in an amount of $3\times10^{-7}$ mole per mole silver halide during the formation of the silver halide grains.

The emulsion comprising 80 mole % silver bromide, 18.7 mole % silver chloride and 1.3 mole % silver iodide was demineralized, added necessary amount of gelatin and thereafter added 3 ml of 0.1% auric chloride solution and 6 ml of 0.1% hypo solution per mole silver halide, and maintained at 61° C. for 50 minutes with stirring, giving a chemical sensitization to afford a highly-sensitive emulsion for flash exposure. The emulsion contained silver halide grains having a mean grain size of 0.7μ in an amount of 1.2 moles per kg emulsion.

The chemically sensitized emulsion was divided into several portions. To one of the portions was added a methanol solution of a sensitizing dye (D-87) or (D-88) in an amount of 75 mg per kg emulsion, and the whole mixture was kept at 50° C. for 30 minutes in order to stabilize the color-sensitizing property. To the emulsion were added, in turn, 1% aqueous solution of 4-hydroxy-6-methyl-1,3,3a,7-tetrazaindene as a stabilizer in an amount of 150 ml per kg emulsion, 20% aqueous solution of saponin as a spreader in an amount of 8 ml per kg emulsion and 1% aqueous solution of mucochloric acid as a hardener in an amount of 15 ml per kg emulsion, with stirring.

The emulsion thus obtained was coated on an under-coated polyethylene terephthalate base and dried, giving samples [2] and [3].

The films, after drying, had a coated emulsion of 4μ thick and contained the silver halide in an amount of 76 mg per 100 $cm^2$ as the silver.

Similarly, sample [1] was obtained, using one of the divided emulsions, following the above-mentioned procedures, except that a sensitizing dye was added into the emulsion.

Each of a part of the coated samples was allowed to stand in full dark for 24 hours in a dry box containing the under-mentioned atmosphere and then heat-sealed with the under-mentioned opaque, non-air permeable package.

Atmosphere condition [1]:
temperature: 23° C.
humidity: 51%
oxygen partial pressure: 1/20 atm.

Atmosphere condition [2]:
temperature: same as in [1]
humidity: same as in [1]
oxygen partial pressure: 1/5 atm.

Package:

A trigonal-sealed compound film comprising Nylon (40μ), aluminum (9μ) and carbon black-darkended polyethylene (40μ) having an oxygen permeability of 0 cc/$m^2$.24 hrs.atm. at 20° C., relative humidity 0%.

After the completely sealed, coated samples were stored for one year at an ambient temperature, they were opened and cut to strips, which were subjected to sensitometry. The strips were exposed for $10^{-6}$ second with a xenon lamp through an interference filter (maximum transmittance, 500 nm) transmitting bluish green light.

The exposed samples were developed at 25° C. for 3 minutes with the under-mentioned developing solution, fixed and washed.

| Developing solution | |
|---|---|
| Metol | 3 g |
| anhydrous sodium sulfite | 50 g |
| hydroquinone | 6 g |
| sodium carbonate | 29.5 g |
| potassium bromide | 5 g |
| water | to make 2 liters. |

The photographic characteristics curves of the samples were determined by using an automatic densitometer (available from Konishiroku Photo Ind.), and the sensitivity of each sample was calculated from the reciprocal number of exposure amount, necessary for the fog and optical density to give a density of "fog+1.0".

The results are shown in Table 7.

The sensitivity was indicated by the relative sensitivity to the sensitivity 100 of the sample [1] immediately after the coating.

TABLE 7

| Sample | Atmosphere condition | Immediately after coating: Relative sensitivity | Immediately after coating: Fog | After one year storage: Relative sensitivity | After one year storage: Fog |
|---|---|---|---|---|---|
| Sample [1] without sensitizing dye | I | 100 | 0.05 | 80 | 0.24 |
| | II | | | 78 | 0.29 |
| Sample [2] with sensitizing dye (D-87) | I | 360 | 0.05 | 210 | 0.43 |
| | II | | | 363 | 0.06 |
| Sample [3] with sensitizing dye (D-88) | I | 320 | 0.05 | 257 | 0.39 |
| | II | | | 327 | 0.07 |

As clearly shown in Table 7, the samples with added sensitizing dye show quite stable sensitivity and fog when stored under the atmosphere condition [II].

EXAMPLE 8

A silver chloroiodobromide emulsion comprising 0.5 mole % iodine content and 20 mole % bromine content was prepared by the double jet method.

The emulsion was matured physically and demineralized, giving an ultra contrast silver halide emulsion.

The silver halide grains in the emulsion had a mean grain size of 0.4μ and more than 80% grains were cubes having a crystal face [1.0.0].

The silver halide was contained in an amount of 1.2 moles per kg emulsion.

Into a vessel, 1 kg of the emulsion was taken, gold- and sulfur-sensitizers were added thereto and the mixture was stirred for 50 minutes, keeping the temperature at 58° C. to complete the chemical maturing.

After the maturing, the emulsion was divided into several portions and a methanol solution of the sensitizing dye (D-75) or (D-85) was added with stirring to each emulsion, according to the combinations and amounts of addition shown in Table 7, and the mixtures were kept for 30 minutes at 52° C. to stabilize the color sensitization.

Further, a 1% aqueous solution of 4-hydroxy-6-methyl-1,3,3a,7-tetrazaindene (80 cc/kg emulsion) as a stabilizer, a 20% aqueous solution of saponin (10 cc/kg emulsion) as a spreader, a 0.2% aqueous solution of polyethylene oxide having a mean molecular weight of 2000 (30 cc/kg emulsion) as a contrast agent and 2% aqueous solution of mucochloric acid (30 cc/kg emulsion) as a hardener were added, in turn, with stirring to the emulsions to prepare sample emulsions.

The sample emulsions thus prepared were coated on undercoated polyethylene terephthalate bases, respectively and dried, giving dry coated films of 5μ thick containing the silver halide in an amount of 52 mg/100 $cm^2$ as silver.

A part of each of the coated samples was allowed to stand, in full dark, for 24 hours in a dry box containing the under-mentioned atmosphere, and then sealed up in situ with an opaque and substantially non-air permeable package mentioned below, by heat-sealing or the like.

Atmosphere condition [I]:

temperature: 23° C.

humidity: 42% oxygen partial pressure: identical with that in the ambient air

Atmosphere condition [II]:

temperature: 23° C.

humidity: 42% oxygen partial pressure: 1/20 atm.

Package:

A trigonal sealed compound material comprising Nylon (40μ), aluminum (9μ) and carbon black-darkened polyethylene (40μ) having an oxygen permeability of 0 cc/$m^2$.24 hrs.atm. at 20° C., 0% relative humidity.

The completely sealed, coated samples were allowed to stand for one year in a room, then opened and cut to strips.

Parts of the strips were wedge-exposed under the exposing conditions mentioned below, then developed, fixed and washed, giving strips having black and white images.

Exposing condition:

The sample was exposed for 1/50 second at an illuminance of 64 lx with a light source having a color temperature of 5400° K.

Developing condition:

The sample was developed for 1 minute at 20° C. with a Metol/hydroquinone developing solution having the following composition:

| | |
|---|---|
| monomethyl-p-aminophenol anhydrous g | 3 g |
| hydroquinone | 6 g |
| sodium carbonate monohydrate | 29.5 g |
| anhdrous sodium sulfite | 50 g |
| potassium bromide | 1 g |
| water | to make 1 liter. |

Then the characteristics curve was measured with a Sakura densitometer (Type PDA-60, available from Konishiroku Photo Ind.) and the sensitivity was determined as a reciprocal number of exposure amount necessary for the fog and the optical density to give a density [fog+1.0].

The results are shown in Table 7. In the table, the sensitivity was indicated as a relative sensitivity of the samples to the sensitivity 100 of the coated sample [1], immediately after the coating.

Apart from the above-mentioned experiments, parts of the opened and cut strips were wedge-exposed and developed under the exposing and developing conditions mentioned below, then fixed, washed and dried, giving strips having dot images.

Exposing condition:

The sample was exposed for 1 second at an illuminance of 125 lx. with a light source having a color temperature of 5400° K. A contact screen [a grey contact screen (negative) elliptical dot 150 lines/inch; available from Eastman Kodak Co.] was fitted at a side of the wedge which the film contacted.

Developing condition:

The sample was step-developed at 27° C. for a conveyance period of 1 min. 10 sec. to 2 min. 30 sec. at 10 minute intervals with a roller conveyance type automatic processor (Type G-17, available from Konishiroku Photo Ind.), by using a developing solution having the under-mentioned composition:

| Infectious developing solution: | |
|---|---|
| hydroquinone | 1.5 g |
| formaldehyde sodium hydrogen-sulfite adduct | 60 g |
| sodium sulfite | 2 g |
| potassium bromide | 2 g |
| sodium carbonate monohydrate | 85 g |
| boric acid | 9 g |
| water | to make 1 liter. (adjusted to pH 9.90 with sodium hydroxide) |

The strips thus obtained having dot images were examined with a microscope, and the parts forming dots were evaluated as from grade 1 to grade 9, denoting the part showing fringes most abundantly as being grade 1.

The largest grade number of dot evaluation of each step-developed strip was denoted as the dot quality of the sample, and the sensitivity at the time was designated as the sensitivity of the sample. The results are shown in Table 8.

The sensitivity was calculated from a reciprocal number of exposure amount to give "fog+0.30 density". In the table, the sensitivity was indicated as a relative sensitivity of the samples to the sensitivity 100 of the coated sample [1], immediately after the coating.

TABLE 8

| | | Characteristics under Metol/hydroquinone development | | | | | Characteristics under infectious development | | | | |
|---|---|---|---|---|---|---|---|---|---|---|---|
| | | | Immediately after coating | | After one year storage | | | Immediately after coating | | After one year storage | |
| Sample No. | Dye added and amount of addition × $10^{-4}$ mg/kg emulsion | Atmosphere condition | Relative sensitivity | Fog | Relative sensitivity | Fog | Atmosphere condition | Relative sensitivity | Dot quality | Relative sensitivity | Dot quality |
| | | I | | | 82 | 0.28 | I | | | 81 | 2 |

TABLE 8-continued

| Sample No. | Dye added and amount of addition × $10^{-4}$ mg/kg emulsion | | Atmosphere condition | Characteristics under Metol/hydroquinone development: Immediately after coating: Relative sensitivity | Fog | After one year storage: Relative sensitivity | Fog | Atmosphere condition | Characteristics under infectious development: Immediately after coating: Relative sensitivity | Dot quality | After one year storage: Relative sensitivity | Dot quality |
|---|---|---|---|---|---|---|---|---|---|---|---|---|
| 1 | — | — | II | 100 | 0.06 | 80 | 0.30 | II | 100 | 4 | 81 | 2 |
| 2 | Light-sensitive dye (D-75) 1.5 | — | I | 185 | 0.06 | 143 | 0.34 | I | 345 | 5 | 230 | 3 |
| | | | II | | | 184 | 0.09 | II | | | 340 | 5 |
| 3 | Light-sensitive dye (D-75) 1.5 | Light-sensitive dye (D-87) 1.5 | I | 207 | 0.07 | 168 | 0.28 | I | 380 | 7 | 255 | 4 |
| | | | II | | | 204 | 0.09 | II | | | 382 | 7 |
| 4 | Light-sensitive dye (D-75) 1.5 | Light-sensitive dye (D-88) 1.5 | I | 193 | 0.06 | 120 | 0.41 | I | 360 | 5 | 245 | 3 |
| | | | II | | | 189 | 0.12 | II | | | 354 | 5 |
| 5 | Light-sensitive dye (D-75) 1.5 | Light-sensitive dye (D-87) 1.5 | I | 205 | 0.07 | 171 | 0.33 | I | 395 | 7 | 305 | 3 |
| | | | II | | | 200 | 0.09 | II | | | 390 | 7 |

As clearly shown in Table 8, the samples containing no light-sensitive dye showed degradation under both atmosphere conditions [I] and [II] with no difference from each other. The samples containing a light-sensitive dye showed degradation under the atmosphere condition [I] as in samples containing no dye, but they showed no degradation under condition [II] and maintained the stability of fog, sensitivity and dot quality.

EXAMPLE 9

A silver iodobromide emulsion containing 2.6 mole % silver iodide was subjected to secondary maturing with sulfur- and gold-sensitizers, added a sensitizing dye (D-50) and stirred for 20 minutes at 40° C. and then allowed to stand to complete the stabilization. After addition of a stabilizer, hardener and coating aid, the emulsion was coated on a film base and dried, giving a light-sensitive material. The photographic material was divided into four, and each sample was sealed up in a can having the below-mentioned quality and according to the below-mentioned method and condition.

One of the package materials was a can made of tin plate of 0.196 mm thick having an oxygen permeability of 0 cc/m$^2$.24 hrs.atm. at 20° C. and 0% relative humidity. A sample was placed in the can and sealed up with an easy open cap in an ambient air by using a rotary seamer. Similarly, a sample was placed in a can of the same material as above and sealed up with an easy open cap in an air of $\frac{1}{4}$ total atmosphere (1/20 oxygen partial pressure) by using a rotary vacuum seamer.

Another package material was a can made of low-density polyethylene of 1 mm thick having an oxygen permeability of $1\times10^4$ cc/m$^2$.24 hrs.atm. at 20° C. and 0% relative humidity. The samples were placed in the can and sealed up in an ambient air or in a dry box containing an atmosphere of 1/20 oxygen partial pressure ($\frac{1}{4}$ total pressure).

The polyethylene can comprised a cap and a body having the same thickness and both were inlaid together with screws, coating silicone grease inside the cap to plug up the thread and the bottom of the thread.

The samples were exposed and developed after three days or one year storage according to the following method. Namely, the samples were exposed for 0.08 second at 80 KVP and 200 mA with an indirect photographic apparatus having a luminescene sensitizing board emitting a maximum wavelength of 530 to 550 nm, and then developed with an automatic processor for 90 seconds processing (Type QX-1200, available from Konishiroku Photo Ind.).

The results are shown in Table 9.

TABLE 9

| Package material (Thickness) | Oxygen permeability cc/m$^2$. 24 hrs. atm. | Oxygen partial pressure | After three months storage: Fog | Sensitivity | After one year storage: fog | sensitivity |
|---|---|---|---|---|---|---|
| Tin plate can (0.196 mm) | 0 | 1/5 | 0.06 | 100 | 0.18 | 90 |
| | | 1/20 | 0.06 | 100 | 0.10 | 98 |
| Polyethylene can (1 mm) | $1\times10^4$ | 1/5 | 0.06 | 100 | 0.19 | 90 |
| | | 1/20 | 0.06 | 100 | 0.17 | 92 |

As clearly shown in Table 9, the sample packed with the aluminum can under 1/20 oxygen partial pressure made slow progress of fog as compared with other samples.

EXAMPLE 10

(1) The following layers were coated on a polyethylene terephthalate support to prepare a light-sensitive material for a image-printing film unit:

Layer 1:

An image-receiving layer containing gelatin (2.7 g/m$^2$) and a polymer containing a quaternary ammonium salt as a mordant (2.7 g/m$^2$).

Layer 2:

A white reflection layer containing titanium oxide (22 g/m$^2$) and gelatin (2.2 g/m$^2$).

Layer 3:

An opaque layer containing carbon (2.8 g/m$^2$) and gelatin (1.8 g/m$^2$)

Layer 4:

A layer dispersing a redox compound (0.54 g/m$^2$) of the following formula releasing a cyan dye in gelatin:

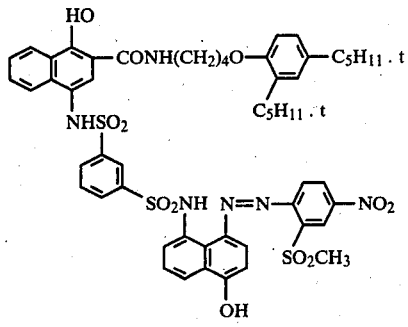

Layer 5:

A red-sensitive emulsion layer comprising an inner latent image type silver chlorobromide (Ag, 0.97 g/m$^2$) red-sensitizied with the sensitizing dye (D-15:150 mg/mole Ag) and containing 1-acetyl-2-{p-[5-amino-2-(2,4-di-t-pentylphenoxy)benzamido]phenyl} hydrazine (8 g/mole Ag).

Layer 6:

An oxidized developer-scavenging layer dispersing di-sec-dodecylhydroquinone (0.75 g/m$^2$) in gelatin.

Layer 7:

A layer dispersing a redox compound (1.1 g/m$^2$) of the following formula releaseing a Magenta dye in gelatin:

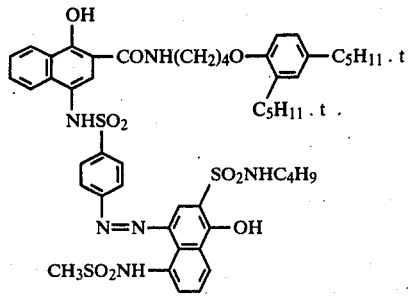

Layer 8:

A green-sensitive emulsion layer containing (D-12) and (D-80) (130 mg and 70 mg/mole Ag, respectively) in place of the sensitizing dye (D-15) in the layer (5).

Layer 9:

The same oxidized developer-scavenging layer as the layer (6).

Layer 10:

A layer dispersing a redox compound (1.2 g/m$^2$) of the following formula releasing a yellow dye in gelatin:

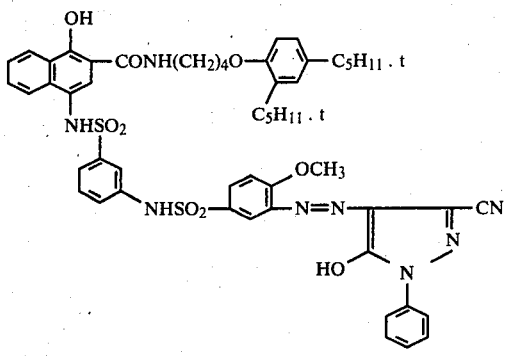

Layer 11:

A blue-sensitive emulsion layer containing (D-81) (150 mg/mole Ag) in place of the sensitizing dye (D-15) of the layer (5).

Layer 12:

(1) A protective layer containing gelatin (5.4 g/m$^2$).

(2) A cover sheet was composed of the following layers on a polyethylene terephthalate support:

an acidic layer comprising acrylic acid (150 g/m$^2$);

a timing layer comprising cellulose acetate (41 g/m$^2$).

(3) A pod for accommodating processing solution was made of a laminated foil comprising an inner layer of a vinyl chloride/vinyl acetate copolymer (35$\mu$), a lead foil (25$\mu$) and a paper (20$\mu$).

It accommodated 1 ml of a viscous processing solution having the following composition in a bag of 20×90 mm:

| | |
|---|---|
| potassium hydroxide | 56.0 g |
| 4-hydroxymethyl-4-methyl-1-phenyl-3-pyrazolidone | 8.0 g |
| sodium sulfite | 2.0 g |
| carbon | 40.0 g |
| 5-methylbenzotriazole | 2.4 g |
| t-butylhydroquinone | 0.2 g |
| hydroxyethylcellulose | 25.0 g |
| water | to make 1 liter |

The preparation and placing of the viscous processing solution into the pod were performed under a nitrogen atmosphere.

A long side of the pod was coated with a weak adhesion layer, adjusting the exfoliation strength to 50–100 g/10 mm.

(4) Construction of light-sensitive sheet and cover sheet integrated body:

The light-sensitive a sheet (1) was cut into sheet of 110×90 mm. On the sheet the processing solution bag was stuck along the short side of the light-sensitive sheet such that the weak adhesion layer was inside.

Then, carbon black-containing polyethylene terephthalate strips of 3×90 mm, 100$\mu$ thick were fixed along the long sides of the sheet as spacers. On the material was placed a cover sheet (2) of 90×90 mm and stuck at the parts of the spacers only. At that time, the gelatin layer of the light-sensitive sheet (1) and the acetyl cellulose layer of the cover sheet (2) were inside, and the processing solution pod (3) and the cover sheet (2) were fixed such that they were piled up on the light-sensitive sheet (1), exactly.

After that, the juncture of the pod and the cover sheet was connected with a pressure-sensitive tape of 4 mm width and 50μ thick so that the viscous processing agent might be distributed between the light-sensitive sheet (1) and the cover-sheet (2) with a pressing roller.

Further, a trapping groove was furnished at the opposite side to the processing solution bag to prevent the overflow of excess solution. Thus the so-called integrated image printing film.

(5) Package: 10 units of the integrated image printing film were accommodated in a cartridge which was not airtight but could serve the purpose of a black box.

The cartridge was sealed up with a laminated package material (oxygen permeability, 0 cc/m$^2$) comprising polyethylene (50μ), aluminum foil (20μ) and paper (20μ). Upon the sealing, a sample A was sealed up in air (oxygen partial pressure, 1/5 atm.; relative humidity, 55%) whereas a sample B was sealed up in nitrogen gas (oxygen partial pressure, 0.03 atm.; relative humidity 55%) throughout the entire sealing procedures.

(6) Test methods and results:

The samples A and B which were allowed to stand for one year in a room, two days at 50° C., or five days at 50° C. were opened in a dark room at 23° C. and 55% relative humidity. The samples were white light-exposed at a color temperature of 5500° K. through an optical wedge from the cover sheet side.

The maximum exposure amount was 16 CMS.

The viscous processing solution was distributed between the cover sheet and the light-sensitive sheet with a pressing roller. After 60 minutes had passed, the samples were taken out in a light room, and the maximum and minimum concentrations (relative values) of printed images formed at the light-sensitive sheet side were measured through blue, green and red filters. The results are shown in Table 10.

TABLE 10.

| Storage condition | Filter | Maximum density (%) | | | Minimum density (ΔD) | | |
|---|---|---|---|---|---|---|---|
| | | Blue | Green | Red | Blue | Green | Red |
| Sample A (in air) | Initial | 100 | 100 | 100 | 0 | 0 | 0 |
| | After one year storage | 123 | 117 | 105 | 0.12 | 0.14 | 0.08 |
| Sample B (in nitrogen) | Initial | 100 | 100 | 100 | 0 | 0 | 0 |
| | After one year storage | 110 | 103 | 98 | 0.01 | 0.02 | 0.02 |

As clearly shown in Table 10, the change of maximum concentration and the increase of minimum concentration were lesser in the samples sealed up in the nitrogen gas.

The abbreviations mentioned in the foregoing description are enumerated below.

C-1: 1-hydroxy-N-[δ-(2,4-di-t-amylphenoxy)butyl]-2;1-naphthamide

C-2: disodium-1-hydroxy-4-[4-(1-hydroxy-8-acetamido-3,6-disulfo-2-naphthylazo)phenoxy]-N-[δ-(2,4-di-t-amylphenoxy)butyl]-2-naphthamide C-3: 1-hydroxy-4-isopropylaminocarbonylmethoxy-N-dodecyl-2-naphthamide C-4: 1-(2,4,6-trichlorophenyl)-4-(1-naphthylazo)-3-(2-chloro-5-octadecenylsuccinimidoanilino)-5-pyrazolone C-5: 1-(2,4,6-trichlorophenyl)-4-(4-methoxyphenylazo-3-[3-(2,4-di-t-amylphenoxyacetamido)benzamido]-5-pyrazolone C-6: 2-perfluorobutylamido-5-[α-(2,4-di-t-amylphenoxy)hexanamide]phenol M-1: 1-(2,4,6-trichlorophenyl)-3-[3-(2,4-di-t-amylphenoxyacetamido)benzamido]-5-pyrazolone M-2: 4,4'-methylenebis-[1-(2,4,6-trichlorophenyl)-3-{3-(2,4-di-t-amylphenoxyacetamido)-benzamido}]-5-pyrazolone M-3: 1-(2,4,6-trichlorophenyl)-3-[3-(2,4-di-t-amylphenoxyacetamido)benzamido]-5-pyrazolone Y-1: α-(1-benzyl-2-phenyl-3,5-dioxo-1,2,4-triazolidine-4-il)-α-pivalyl-2-chloro-5-[γ-(2,4-di-t-amylphenoxy)-butylamido]acetanilide Y-2: α-(1-benzyl-2,4-dioxoimidazolidine-3-il)-α-pivalyl-2-chloro-5-[γ-(2,4-di-t-amylphenoxy)-butylamido]acetanilide

What is claimed is:

1. A process of sealing a light-sensitive photographic silver halide material comprising a support and a silver halide emulsion layer containing a development-inhibitor-releasing compound coated thereon and containing a sensitizing dye or a desensitizing dye in a package, which process comprises sealing said package in an atmosphere having a partial pressure of an oxygen gas of not more than 1/6 atmosphere, said package having an oxygen permeability of not more than $5\times10^2$ cc/m$^2$.24 hrs. atm. at 20° C. and 0% relative humidity.

2. A process of sealing a light-sensitive photographic silver halide material comprising a support and a silver halide emulsion layer containing a development-inhibitor-releasing compound coated thereon and containing a sensitizing dye or a desensitizing dye in a package, which process comprises incorporating a deoxygenating agent into the package, said package having an oxygen permeability of not more than $5\times10^2$ cc/m$^2$.24 hrs. atm. at 20° C. and 0% relative humidity, and thereafter sealing said package, whereby partial pressure of an oxygen gas in the package becomes not more than 1/6 atms. at an initial stage.

3. A photographic product comprising a sealed package containing a light-sensitive silver halide photographic material, the photographic material comprising a support and a silver halide emulsion layer coated thereon and containing a sensitizing or desensitizing dye and a development-inhibitor-releasing compound, the oxygen permeability of the package being not more than $5\times10^2$ cc/m$^2$.24 hrs. atm. at 20° C. and 0% relative humidity, and a partial pressure of an oxygen gas in the package being not more than 1/6 atmosphere at an initial stage.

4. A photographic product comprising a sealed package containing a light-sensitive silver halide photographic material and a deoxygen agent, the photographic material comprising a support and a silver halide emulsion layer containing a development-inhibitor-releasing compound coated thereon and containing a sensitizing or desensitizing dye, the oxygen permeability of the package being not more than $5\times10^2$ cc/m$^2$.24 hrs. atm. at 20° C. and 0% relative humidity, and a partial pressure of an oxygen gas in the package being not more than 1/6 atmosphere at an initial stage.

5. A photographic product as claimed in claim 3 wherein when said package is sealed, it also contains a deoxygen agent which withdraws oxygen from the gas in the package so that the remaining oxygen in the gas in the package has a partial pressure of less than 1/6 atmosphere.

6. A photographic product as claimed in claim 3 wherein the oxygen permeability is not more than $2\times10^2$ cc/m$^2$.24 hrs. atm. at 20° C. and 0% of relative humidity.

7. A photographic product as claimed in claim 6 wherein the oxygen permeability is not more than $1\times10^2$ cc/m$^2$.24 hrs. atm. at 20° C. and 0% of relative humidity.

8. A photographic product as claimed in claim 3 wherein the partial pressure of the oxygen gas in the package is not more than 1/10 atmosphere.

9. A photographic product as claimed in claim 8 wherein the partial pressure is not more than 1/20 atmosphere.

10. A photographic product as claimed in claim 3 wherein the silver halide emulsion layer contains a sensitizing dye.

11. A photographic product as claimed in claim 10 wherein the sensitizing dye is represented by general formula [I]:

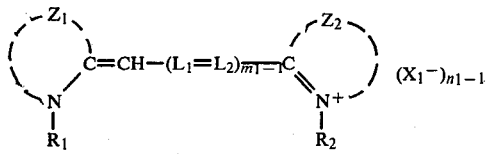

(wherein, $Z_1$ and $Z_2$ each represents a group necessary for forming a heterocyclic nucleus usually employed for the cyanine dye such as thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole and indolenine nuclei which may be substituted with a lower alkyl group such as methyl, a halogen atom, a phenyl group, a hydroxy group, an alkoxy group having 1 to 4 carbon atoms, a carboxy group, an alkoxycarbonyl group, an alkyl sulfamoyl group, an alkylcarbamoyl group, an acetyl group, an acetoxy group, a cyano group, a trichloromethyl group, a trifluoromethyl group and/or a nitro group; $L_1$ or $L_2$ represents a methine group or a substituted methine group, wherein the substituent is usually an alkyl group such as methyl or ethyl, a phenyl group including phenyl and substituted phenyl, a methoxy group or the like; $R_1$ and $R_2$ each represents an alkyl group having 1 to 5 carbon atoms, substituted alkyl having a carboxy group, substituted alkyl having a sulfo group such as γ-sulfopropyl, δ-sulfobutyl, 2-(3-sulfopropoxy)ethyl, 2-[2-(3-sulfopropoxy)ethoxy]ethyl, 2-hydroxysulfopropyl, an allyl group or a substituted alkyl group usually employed for the N-substituent of the cyanine dye; $m_1$ represents 1, 2 or 3; $X_1^-$ represents an acid anion usually employed for the cyanine dye such as iodine, bromine, p-toluenesulfonic acid or perchloric acid anion; and n represents 1 or 2, provided that n is 1 when the dye molecule forms a betaine structure)

or general formula [II]:

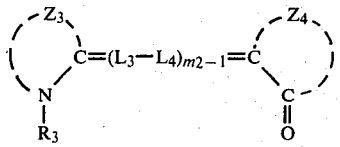

(wherein, $Z_3$ is an atomic group necessary for forming a heterocyclic nucleus usually employed for a cyanine dye, particularly, thiazole, thiazoline, benzothiazole, naphthothiazole, oxazole, oxazoline, benzoxazole, naphthoxazole. tetrazole, pyridine, quinoline, imidazoline, imidazole, benzimidazole, naphthoimidazole, selenazoline, selenazole, benzoselenazole, naphthoselenazole and indolenine nuclei; $Z_4$ represents an atomic group necessary for forming a ketoheterocyclic nucleus usually employed for a merocyanine dye such as rhodanine, thiohydantoin, hydroxyindole, 2-thiooxazolinedione and 1,3-indanedione nuclei; $L_3$ and $L_4$ each represents methine or methine substituted with a lower alkyl group such as methyl and ethyl, phenyl, substituted phenyl, methoxy and/or ethoxy; $R_3$ has the same meaning as previously defined for $R_1$ and $R_2$; and $m_2$ represents 1, 2 or 3).

12. A photographic product as claimed in claim 10 wherein the silver halide emulsion layer further comprises a two equivalent coupler that is substantially colorless which reacts with an oxidation product of an aromatic primary amine developing agent.

13. A photographic product as claimed in claim 4 wherein the silver halide emulsion layer comprises a development-inhibitor releasing compound.

14. A photographic product as claimed in claim 4 wherein the deoxygenating agent comprises an active iron oxide compound.

* * * * *